US008162097B2

(12) United States Patent
Odagawa

(10) Patent No.: US 8,162,097 B2
(45) Date of Patent: Apr. 24, 2012

(54) SOUND WAVE GENERATOR AND METHOD FOR PRODUCING THE SAME, AND METHOD FOR GENERATING SOUND WAVES USING THE SOUND WAVE GENERATOR

(75) Inventor: Akihiro Odagawa, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/980,960

(22) Filed: Dec. 29, 2010

(65) Prior Publication Data

US 2011/0094823 A1 Apr. 28, 2011

Related U.S. Application Data

(63) Continuation of application No. PCT/JP2010/003709, filed on Jun. 3, 2010.

(30) Foreign Application Priority Data

Jun. 8, 2009 (JP) ..... 2009-136964

(51) Int. Cl.
*G10K 15/04* (2006.01)

(52) U.S. Cl. ..... 181/142

(58) Field of Classification Search ..... 181/142; 427/228, 379

See application file for complete search history.

(56) References Cited

U.S. PATENT DOCUMENTS 3,532,181 A * 10/1970 Brienza et al. ..... 250/216
4,137,991 A * 2/1979 Melcher et al. ..... 181/142
5,200,932 A * 4/1993 Ljung ..... 367/174
5,359,352 A * 10/1994 Saita et al. ..... 347/62
5,996,345 A * 12/1999 Hofler ..... 60/517
6,034,478 A * 3/2000 Kawade et al. ..... 315/169.1
2005/0201575 A1 9/2005 Koshida et al.
2007/0266788 A1 * 11/2007 Kim ..... 73/588
2008/0103062 A1 * 5/2008 Williams et al. ..... 506/18
2009/0145686 A1 6/2009 Watabe et al.

FOREIGN PATENT DOCUMENTS

JP 2004-153797 5/2004
JP 2005-73197 3/2005
JP 2005-150797 6/2005

(Continued)

OTHER PUBLICATIONS

Shinoda, et al., "Thermally induced ultrasonic emission from porous silicon", Nature, vol. 400. Aug. 1999, pp. 853-855.

(Continued)

*Primary Examiner* — Forrest M Phillips
(74) *Attorney, Agent, or Firm* — Hamre, Schumann, Mueller & Larson, P.C.

(57) ABSTRACT

A sound wave generator that exhibits more excellent output properties than conventional ones, based on the combination of a base layer and a heat-insulating layer that cannot be expected from conventional techniques is provided. The sound wave generator includes a base layer; a heat-insulating layer disposed on the base layer; and a heat pulse source that applies heat pulses to the heat-insulating layer. The base layer is composed of graphite or sapphire, and the heat-insulating layer is composed of crystalline fine particles containing silicon or germanium. The heat pulse source, for example, is a heat pulse-generating layer that is disposed on the surface of the heat-insulating layer opposite to the base layer and applies heat pulses to the heat-insulating layer.

32 Claims, 22 Drawing Sheets

FOREIGN PATENT DOCUMENTS

| | | |
|---|---|---|
| JP | 2005-152779 | 6/2005 |
| JP | 2005-269745 | 9/2005 |
| JP | 3808493 | 5/2006 |
| JP | 3798302 | 7/2006 |
| JP | 2006-300634 | 11/2006 |
| JP | 3845077 | 11/2006 |
| WO | 2004/077881 | 9/2004 |
| WO | 2007/049496 | 5/2007 |

OTHER PUBLICATIONS

The Society of Chemical Engineers, Japan, the 37th Annual Meeting in Autumn, symposium on <nanoprocessing>, proceedings D-307, 2005, 12 pages—partial translation.

Watabe, et al., "Ultrasonic Sensors Employing MEMS and Nonotechnologies", Matsushita Electric Works Technical Report, vol. 53, No. 2, May 2005, pp. 25-30.

* cited by examiner

SOUND WAVE GENERATOR AND METHOD FOR PRODUCING THE SAME, AND METHOD FOR GENERATING SOUND WAVES USING THE SOUND WAVE GENERATOR

BACKGROUND OF THE INVENTION

1. Field of the Invention

The present invention relates to a thermal excitation-type sound wave generator and a method for producing the same, and to a method for generating sound waves using the sound wave generator.

2. Description of Related Art

Conventionally, various types of sound wave generators are known. Except for a few of special sound wave generators, most of the types generate sound waves by converting mechanical vibration in their vibrating part into vibration in a medium (for example, air). However, in such a sound wave generator that uses mechanical vibration, the vibrating part has a characteristic resonance frequency, and therefore the frequency bandwidth of the sound waves to be generated is narrow. In addition to this, the resonance frequency varies depending on the size of the vibrating part. Thus, miniaturization and array alignment of the generator are difficult to achieve with its frequency properties being maintained.

On the other hand, there is proposed a sound wave generator that is based on a new principle and does not use mechanical vibration. This sound wave generator is called a thermal induction-type sound wave generator and is disclosed in each of the following literatures. Nature, vol. 400, pp. 853-855, 26 Aug. 1999, discloses a sound wave generator in which a base layer (p-type crystalline Si layer) with a relatively high thermal conductivity and a heat-insulating layer (microporous Si layer) with a relatively low thermal conductivity are combined, and an Al(aluminium) thin film is further disposed thereon with the heat-insulating layer interposed between the Al thin film and the base layer. The Society of Chemical Engineers, Japan, the 37th Annual Meeting in Autumn, symposium on <nanoprocessing>, proceedings D-307 (2005), discloses a sound wave generator in which a base layer (single-crystal Si layer) with a relatively high thermal conductivity and a heat-insulating layer (nanocrystalline porous Si layer) with a relatively low thermal conductivity are combined, and a W (tungsten) thin film is further disposed thereon with the heat-insulating layer interposed between the W thin film and the base layer. Nature, vol. 400, pp. 853-855, 26 Aug. 1999, and The Society of Chemical Engineers, Japan, the 37th Annual Meeting in Autumn, symposium on <nanoprocessing>, proceedings D-307 (2005), describe that: upon the supply of electric power including an alternating current component to the Al thin film or W thin film, the temperature of the corresponding thin film periodically changes due to Joule heat; the periodic temperature change is transferred to the air in contact with the thin film without escaping to the side of the base layer because the heat-insulating layer has a low thermal conductivity; and the periodic temperature change that has been transferred to the air induces a periodical change in the density of the air so as to allow sound waves to be generated.

A thermal induction-type sound wave generator can generate sound waves without mechanical vibration. Therefore, the frequency bandwidth of the sound waves to be generated is broad. In addition to this, miniaturization and array alignment of the generator are comparatively easy to achieve.

JP 3798302 B2 discloses that heat application using a pulse current is preferable for increasing power of the sound waves to be generated, in a thermal excitation-type sound wave generator. JP 3798302 B2 further discloses a heat-insulating layer having a surface with a projection.

JP 2005-150797 A discloses a technique for applying a current that has been produced by superimposition of a direct current on an alternating current to a thermal excitation-type sound wave generator. JP 2005-150797 A describes a sound wave generator including a base layer that is a single-crystal Si substrate and a heat-insulating layer that is a porous Si layer.

JP 3845077 B2 discloses a sound wave generator including a heat-insulating layer (nanocrystalline Si layer) obtained by anodization and supercritical drying. JP 3845077 B2 further discloses that: the sound pressure to be output increases as the ratio of the thermophysical parameter $\alpha C$ ($\alpha$: thermal conductivity, C: heat capacity) of the heat-insulating layer with respect to the $\alpha C$ of the base layer decreases; the $\alpha C$ of the heat-insulating layer decreases as the porosity of the heat-insulating layer increases; and a nanocrystalline Si layer with a porosity of 75% or more is preferable as the heat-insulating layer.

JP 3808493 B2 discloses a sound wave generator in which the ratio $\alpha_1 C_1/\alpha_s C_s$ (I: heat-insulating layer, S: base layer) of the $\alpha C$ of the heat-insulating layer with respect to the $\alpha C$ of the base layer satisfies the formula: $1/100 \geqq \alpha_1 C_1/\alpha_s C_s$, and the $\alpha C$ of the base layer satisfies the formula: $\alpha_s C_s \geqq 100\times10^6$. The technique of JP 3808493 B2 is based on a technical idea of combining a base layer and a heat-insulating layer so that the thermal contrast between the base layer and the heat-insulating layer, which is given by the formula: $\alpha_1 C_1/\alpha_s C_s$, exceeds 1:100, and on a technical idea of selecting the base layer with a high $\alpha C$. JP 3808493 B2 describes silicon, copper and $SiO_2$ as a material for constituting the base layer and describes porous silicon, polyimide, $SiO_2$, $Al_2O_3$ and polystyrene foam as a material for constituting the heat-insulating layer. The combination of the base layer composed of silicon and the heat-insulating layer composed of porous silicon is mentioned in JP 3808493 B2 as the most preferable combination of the base layer and the heat-insulating layer.

SUMMARY OF THE INVENTION

According to JP 3845077 B2 and JP 3808493 B2, the sound pressure to be output in the sound wave generator is determined by the $\alpha C$ of the base layer and the thermal contrast $\alpha_1 C_1/\alpha_s C_s$ between the base layer and the heat-insulating layer. However, this is not necessarily true in practice. The inventor has found that the output properties of a sound wave generator cannot be determined simply by these thermal properties of the base layer and the heat-insulating layer. One of the causes may presumably be that heat transfer and dissipation proceed through a very complex process in such a small structure as a sound wave generator.

The present invention provides a sound wave generator that exhibits more excellent output properties than conventional ones, based on the combination of a base layer and a heat-insulating layer that is inconceivable from conventional techniques.

The sound wave generator of the present invention includes a base layer, a heat-insulating layer disposed on the base layer, and a heat pulse source that applies heat pulses to the heat-insulating layer. The base layer is composed of graphite or sapphire. The heat-insulating layer is composed of crystalline fine particles containing silicon or germanium.

The production method of the sound wave generator of the present invention is a method for producing the above-mentioned sound wave generator of the present invention and includes the following first step and second step. The first step is the step of forming, on a base layer composed of graphite or sapphire, a coating layer of a solution in which crystalline fine particles containing silicon or germanium are dispersed, followed by heat treatment of the formed coating layer, so as to form a heat-insulating layer composed of the fine particles on the base layer. The second step is the step of providing a heat pulse source that applies heat pulses to the heat-insulating layer.

The method for generating sound waves according to the present invention is a method for generating sound waves using a sound wave generator. The sound wave generator includes a base layer, a heat-insulating layer disposed on the base layer, and a heat pulse source that applies heat pulses to the heat-insulating layer. The base layer is composed of graphite or sapphire. The heat-insulating layer is composed of crystalline fine particles containing silicon or germanium. The method includes the step of applying heat pulses to the heat-insulating layer by the heat pulse source so as to generate sound waves.

The present invention achieves a sound wave generator that, exhibits more excellent output properties than conventional ones.

DETAILED DESCRIPTION OF THE INVENTION

<Sound Wave Generator>

Figure 1:
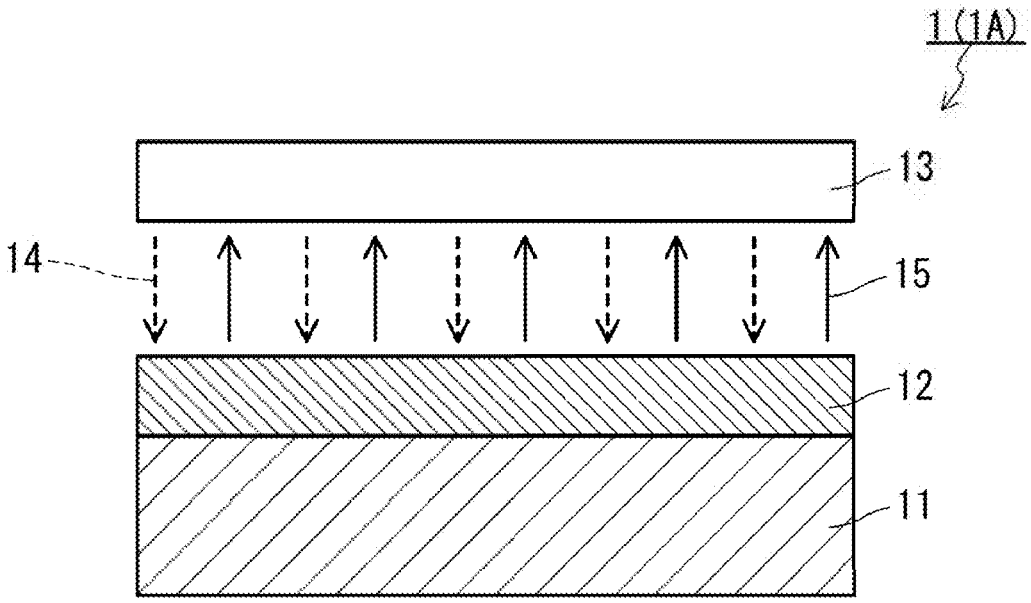
FIG. 1 is a sectional view schematically showing an example of the sound wave generator of the present invention.

FIG. 1 shows an example of the sound wave generator of the present invention. A sound wave generator 1 (1A) shown in FIG. 1 includes a base layer 11, a heat-insulating layer 12, and a heat pulse source 13. The base layer 11 is disposed on the heat-insulating layer 12 in contact with the heat-insulating layer 12. The base layer 11 is composed of graphite or sapphire. The heat-insulating layer 12 is composed of crystalline fine particles containing silicon or crystalline fine particles containing germanium. The heat pulse source 13 is disposed so as to be capable of applying heat pulses 14 to the surface of the heat-insulating layer 12 opposite to the base layer 11.

In a sound wave generator 1A, when the heat pulses 14 are applied to the heat-insulating layer 12 from the heat pulse source 13, most of the thermal energy given to the heat-insulating layer 12 by an alternating current component in the heat pulses 14 is transferred to a medium (for example, air) that is in contact with the heat-insulating layer 12. At this time, the thermal energy transferred to the medium changes over time corresponding to the waveform of the alternating current component. Thus, the density of the medium in the vicinity of the heat-insulating layer 12 changes over time, so that sound waves 15 are generated. Except for the heat pulses 14 having a sine waveform, the heat pulses 14 generally include an alternating current component and a direct current component. The thermal energy given to the heat-insulating layer 12 by the direct current component in the heat pulses 14 does not change over time, which therefore makes no contribution to the generation of the sound waves 15. Such thermal energy is transferred from the heat-insulating layer 12 to the base layer 11 so as to be removed from the heat-insulating layer 12. The change in the density of the medium in the vicinity of the heat-insulating layer 12 to be caused by application of the heat pulses 14 may be periodic or non-periodic.

In order to achieve a sound wave generator having excellent output properties, it is necessary to achieve a heat flow state that allows the thermal energy by the alternating current component in the heat pulses to be converted efficiently into sound waves as well as the thermal energy by the direct current component to be released efficiently into the base layer. Conventional techniques have focused only on the contrast of the thermophysical parameter (thermal contrast) between a base layer and a heat-insulating layer, which is given by the products $\alpha C$ of the thermal conductivity $\alpha$ and the heat capacity C of the materials each constituting the two layer. In contrast, the sound wave generator of the present invention achieves the above-described heat flow state suitable for the sound wave generation of thermal induction type due to the combination of the base layer 11 and the heat-insulating layer 12 each composed of a particular material, which is not a combination conventionally present. In addition to this, the sound wave generator of the present invention has higher output properties than conventional ones.

The base layer 11 is a layer composed of graphite or sapphire. As long as the effects of the present invention are obtained, the base layer 11 may contain a material other than graphite or sapphire. The base layer 11 is typically a layer having a surface that is formed of graphite or sapphire and in contact with the heat-insulating layer 12.

The form of the base layer 11 is not limited. Corresponding to the use of the sound wave generator 1 of the present invention, the form of the base layer 11 is selected arbitrarily. The base layer 11 is typically in the form of a sheet, but may be in a three-dimensional form. Specific examples of the three-dimensional form include the form in which the surface in contact with the heat-insulating layer 12 is in the form of a paraboloid, as shown in Example 4.

The heat-insulating layer 12 is composed of crystalline fine particles containing silicon or crystalline fine particles containing germanium. The fine particles are typically fine particles of a silicon crystal or fine particles of a germanium crystal. As long as the effects of the present invention are obtained, the heat-insulating layer 12 may contain a material other than such fine particles. Examples of the material include: particles formed of another material; particles that are formed of silicon crystal or germanium crystal, but have a larger particle size; particles containing amorphous silicon or amorphous germanium; particles containing silicon oxide or germanium oxide; and an arbitrary material present between these particles.

The "fine particles" in this specification typically have an average particle size of at least 10 nm but not more than 0.5 μm. Here, the average particle size of fine particles means the median of the particle size distribution of the fine particles in the heat-insulating layer 12. The particle size distribution of the fine particles can be determined by image analysis of the heat-insulating layer 12 using a scanning electron microscope (SEM) or a transmission electron microscope (TEM). The "particle size of a fine particle" to be measured in the determination of the particle size distribution is defined by the long side of a quadrangle with the minimum area that circumscribes the cross-sectional profile of a fine particle, which has been selected as the largest cross-sectional profile in the fine particle. In the case of the fine particle being in the form of a sphere, the particle size of the fine particle is equal to the diameter of the sphere.

The fine particles in the heat-insulating layer 12 preferably have a particle size distribution where the values of the particle size from D10 (the particle size at a cumulative percentage of 10% in the distribution) to D90 (the particle size at a cumulative percentage of 90% in the distribution) fall within the range of at least 10 nm but not more than 0.5 μm.

The "crystalline fine particles" mean fine particles for which a diffraction peak or a spectrum peak specific to a silicon crystal or germanium crystal is observed by wide-angle X-ray diffraction (WAXD) measurement or Raman spectroscopy.

The form of the crystalline fine particles containing silicon or germanium that constitute the heat-insulating layer 12 (hereinafter, referred to simply as "fine particles") is not limited. The fine particles, for example, are in the form of flakes or in the form of spheres. The form of the fine particles can be confirmed by image analysis of the heat-insulating layer 12 using SEM or TEM.

Figure 2:
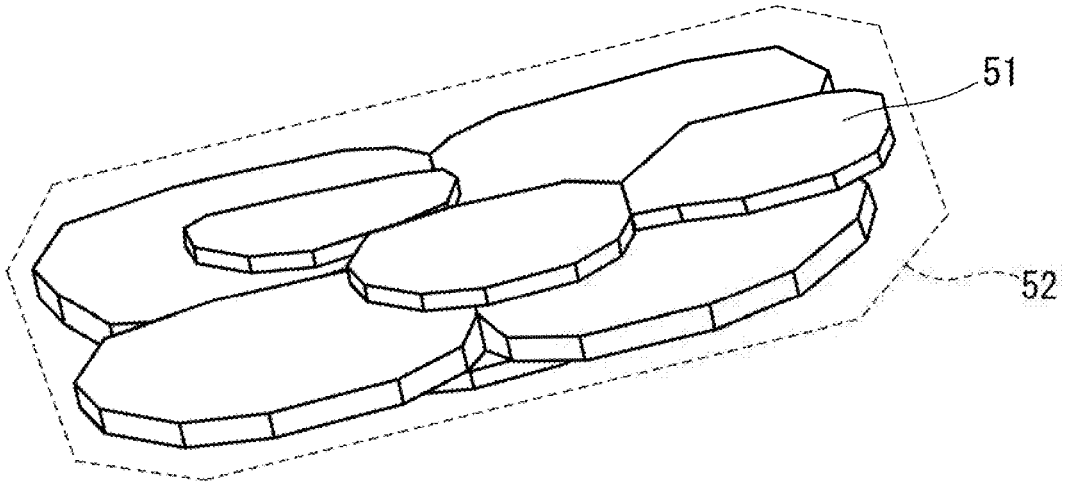
FIG. 2 is a perspective view schematically showing an example of the structure of crystalline fine particles (secondary particles) containing silicon or germanium that are included in the heat-insulating layer of the sound wave generator of the present invention.
Figure 3:
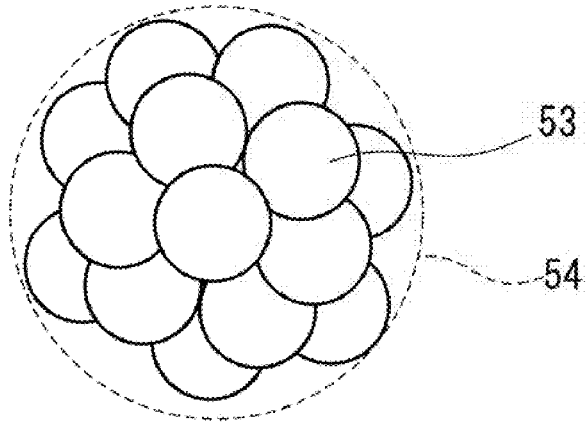
FIG. 3 is a plan view schematically showing another example of the structure of crystalline fine particles (secondary particles) containing silicon or germanium that are included in the heat-insulating layer of the sound wave generator of the present invention.

Generally, primary particles of the fine particles and secondary particles formed by agglomeration of the primary particles are mixedly present in the heat-insulating layer 12. The secondary particles have the same form as the primary particles in most cases, though the particle size thereof is different. FIGS. 2 and 3 show examples of the secondary particles of the fine particles. In the example shown in FIG. 2, primary particles 51 are in the form of flakes, and secondary particles 52 each of which is formed by agglomeration of the primary particles 51 also are in the form of flakes, reflecting the form of the primary particles 51. In the example shown in FIG. 3, primary particles 53 are in the form of spheres, and secondary particles 54 each of which is formed by agglomeration of the primary particles 53 also are in the form of spheres, reflecting the form of the primary particles 53. The mixed state of the primary particles and the secondary particles in the heat-insulating layer 12, the ratio between the primary particles and the secondary particles in the heat-insulating layer 12, and the form of the secondary particles can be confirmed by image analysis of the heat-insulating layer 12 using SEM or TEM.

In the case where the primary particles and the secondary particles of the fine particles are mixedly present in the heat-insulating layer 12, the average particle size of each of the primary particles and the secondary particles is typically at least 10 nm but not more than 0.5 μm. Further, in this case, the values of the particle size from D10 to D90 in the particle size distribution of each of the primary particles and the secondary particles preferably fall within the range of at least 10 nm but not more than 0.5 μm.

Figure 12A:
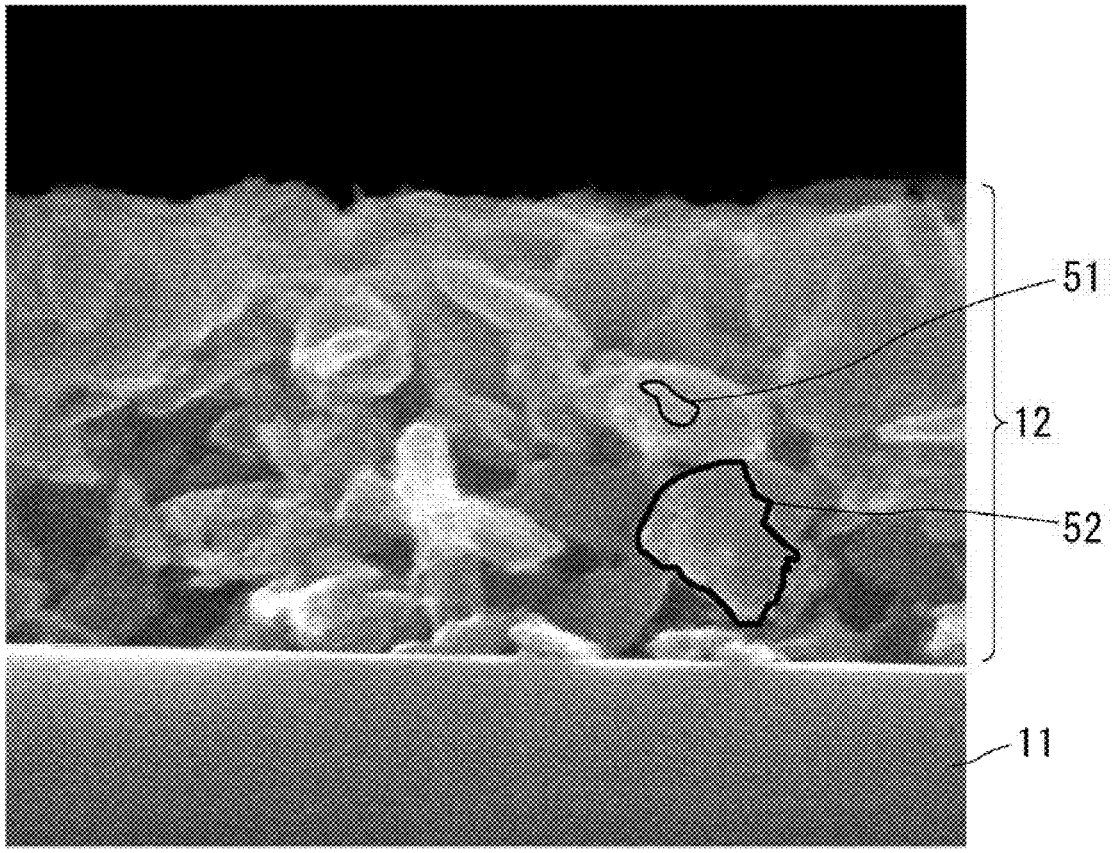
FIG. 12A is a view showing a scanning electron microscope (SEM) image of the cross section of the heat-insulating layer produced in Example 1.
Figure 12B:
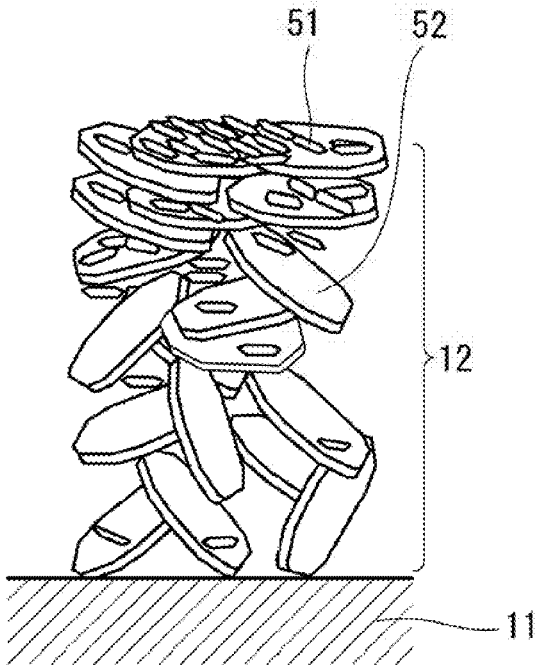
FIG. 12B is an illustration schematically showing the cross section shown in FIG. 12A.
Figure 18A:
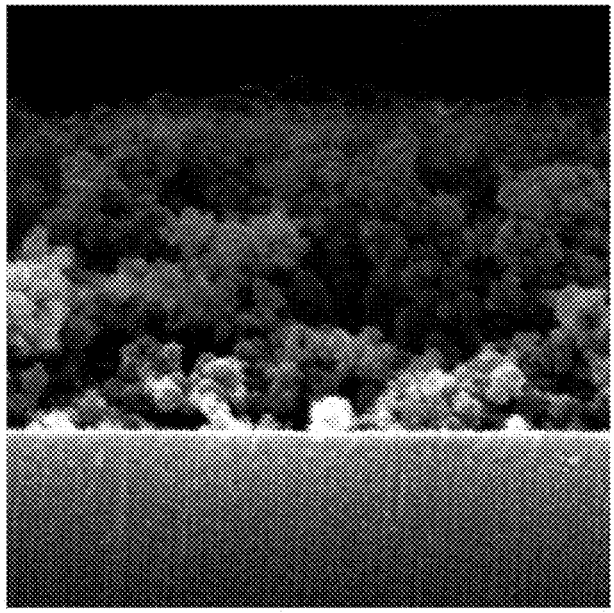
FIG. 18A is a view showing an SEM image of the cross section of the heat-insulating layer produced in Example 3.
Figure 18B:
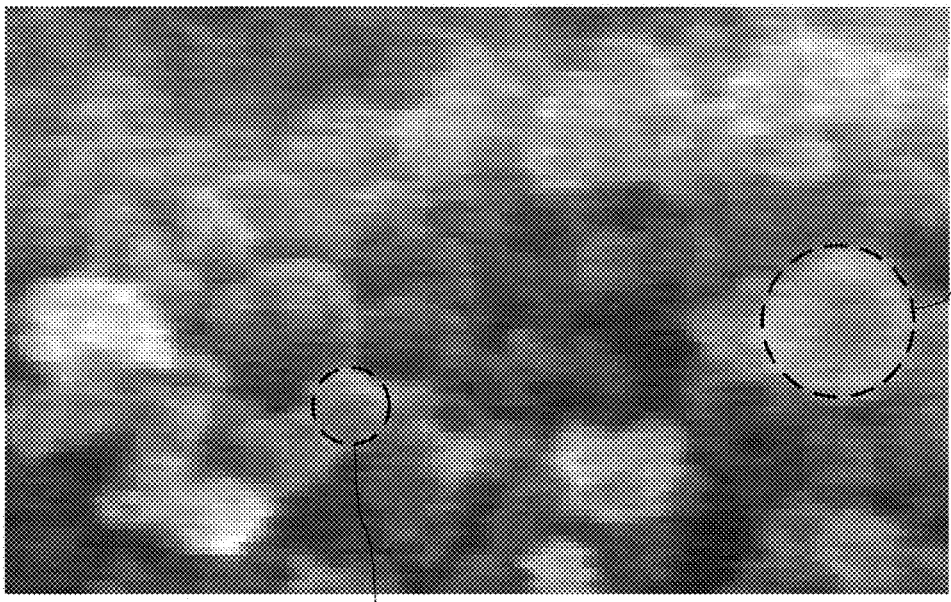
FIG. 18B is a view showing an SEM image of the cross section of the heat-insulating layer produced in Example 3.
Figure 18C:
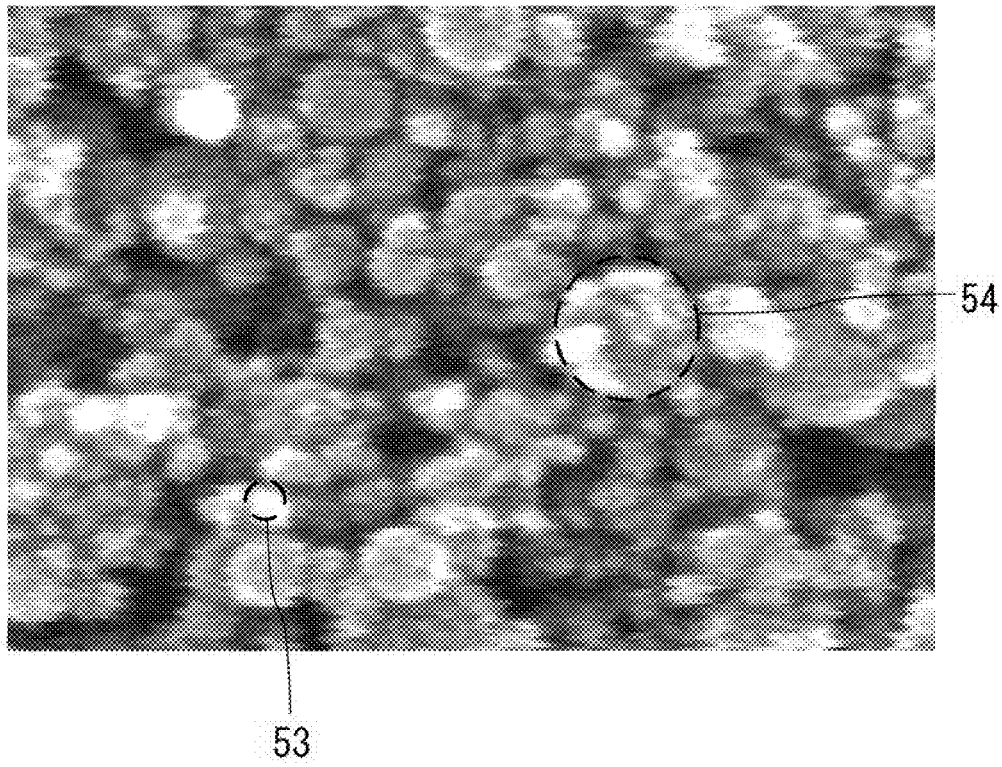
FIG. 18C is a view showing an SEM image of the cross section of the heat-insulating layer produced in Example 3.
Figure 18D:
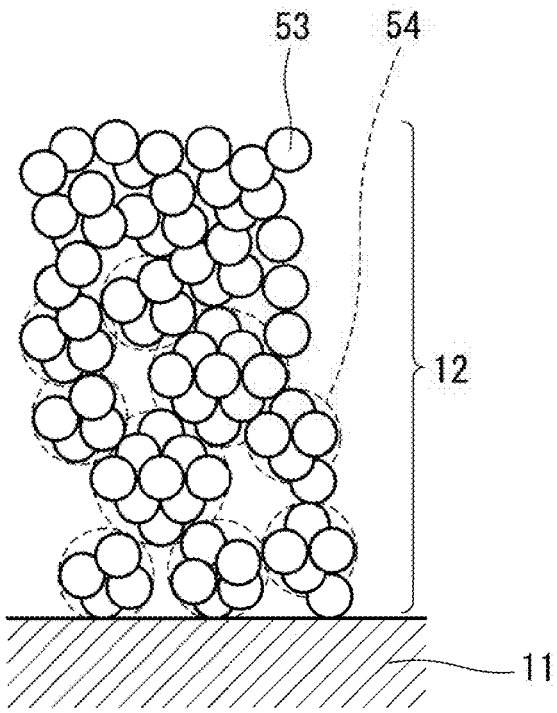
FIG. 18D is a view schematically showing the cross sections shown in FIG. 18A to FIG. 18C.

The structure of the heat-insulating layer 12 is not limited as long as the heat-insulating layer 12 is composed of crystalline fine particles containing silicon or germanium and is disposed on a base layer composed of graphite or sapphire. FIG. 12A shows an SEM image of the cross section of the heat-insulating layer 12 produced in Example 1 that is composed of fine particles in the form of flakes, and FIG. 12B shows a view schematically illustrating the cross section thereof. FIGS. 18A to 18C each show an SEM image of the cross section of the heat-insulating layer 12 produced in Example 3 that is composed of fine particles in the form of spheres, and FIG. 18D shows a view schematically illustrating the cross section thereof. As shown in these figures, the heat-insulating layer 12 preferably has a structure in which fine particles are deposited and accumulated so as to contain an innumerable number of voids between the fine particles. In other words, the heat-insulating layer 12 preferably has a porous structure in which fine particles are accumulated at random, instead of a closely packed structure. In this case, the state of heat flow in the heat-insulating layer 12 and the state of heat flow between the heat-insulating layer 12 and the base layer 11 are rendered suitable for generating the sound waves 15, resulting in still higher output properties of the sound wave generator 1.

The fraction of the voids to be contained in the heat-insulating layer 12 shown in FIGS. 12A, 12B and 18A to D differs depending on the portion of the heat-insulating layer 12. Specifically, the lower portion of the heat-insulating layer 12 (the portion of the heat-insulating layer 12 on the side of the base layer 11) has a higher fraction of the voids to be contained than the upper portion (the portion of the heat-insulating layer 12 opposite to the base layer 11). That is, this heat-insulating layer 12 has a particle density gradient of the fine particles that increases gradually from the side of the base layer 11 in its thickness direction. The heat-insulating layer 12 preferably has such a structure. In this case, the state of heat flow in the heat-insulating layer 12 and the state of heat flow between the heat-insulating layer 12 and the base layer 11 are rendered suitable for generating the sound waves 15, resulting in still higher output properties of the sound wave generator 1.

In addition to this, the heat-insulating layer 12 shown in FIGS. 12A, 12B and 18A to D has a structure in which fine particles having a comparatively large particle size are held in the lower portion thereof, and fine particles having a comparatively small particle size are held in the upper portion. That is, the heat-insulating layer 12 has a particle size gradient of the fine particles that decreases gradually from the side of the base layer 11 in its thickness direction. The heat-insulating layer 12 preferably has such a structure. In this case, the state of heat flow in the heat-insulating layer 12 and the state of heat flow between the heat-insulating layer 12 and the base layer 11 are rendered suitable for generating the sound waves 15, resulting in still higher output properties of the sound wave generator 1.

The heat-insulating layer 12 further preferably has a particle density gradient that increases gradually from the side of the base layer 11 and a particle size gradient of the fine particles that decreases gradually from the side of the base layer 11 in its thickness direction. The sound wave generator 1 of the present invention having the heat-insulating layer 12 as mentioned above can be produced, for example, by the production method of the present invention.

In the heat-insulating layer 12 shown in FIGS. 12A, 12B and 18A to D, fine particles are bound to each other at a very small portion thereof. Here, it is preferable that an oxide film be formed on the portion at which the fine particles are bound to each other, and the fine particles be bound to each other via this oxide film. In this case, the state of heat flow in the heat-insulating layer 12 and the state of heat flow between the heat-insulating layer 12 and the base layer 11 are rendered further suitable for generating the sound waves 15, resulting in still higher output properties of the sound wave generator 1. The oxide film is composed, for example, of $SiO_2$, in the case of crystalline fine particles containing silicon. It is composed, for example, of $GeO_2$ in the case of crystalline fine particles containing germanium. The portion where an oxide film is formed in the fine particles extends, for example, over the length of about 2 to 10 nm. The oxide film may be formed by natural oxidation, or may be formed by a positive method for oxidation, such as plasma oxidation or radical oxidation.

The heat-insulating layer 12 is at least required to have a thickness such that the generation of the sound waves 15 is not stopped due to a thermal short circuit between the base layer 11 and the heat pulse source 13. On the other hand, in order to prevent the generation efficiency of the sound waves 15 from decreasing due to heat retention, especially the retention of heat applied to the heat-insulating layer 12 by the direct current component in the heat pulses 14 that makes no contribution to the generation of the sound waves 15, an excessive thickness of the heat-insulating layer 12 should be avoided. In view of these, the thickness of the heat-insulating layer 12 is preferably 10 nm to 50 μm, more preferably 50 nm to 10 μm.

The structure of the heat pulse source 13 and the arrangement of the heat pulse source 13 in the sound wave generator of the present invention are not limited as long as the heat pulse source 13 is capable of applying heat pulses to the heat-insulating layer 12.

In the sound wave generator 1A shown in FIG. 1, the heat pulse source 13 is arranged separately from the stack of the base layer 11 and the heat-insulating layer 12. In such a sound wave generator, the heat pulse source 13 is generally arranged so as to be capable of applying the heat pulses 14 to the heat-insulating layer 12 from the surface of the heat-insulating layer 12 opposite to the base layer 11. In the case of the base layer 11 being composed of sapphire, it also is possible to arrange the heat pulse source 13 so as to be capable of applying the heat pulses 14 to the heat-insulating layer 12 from the surface of the heat-insulating layer 12 on the side of the base layer 11, depending on the type of the heat pulse source 13 (for example, excimer laser and YAG laser), because sapphire is transparent with respect to light having a wavelength of about 0.2 to 5 μm.

The heat pulse source 13, for example, is provided with a laser irradiation device or an infrared irradiation device. Laser, for example, is a pulse laser. In this case, the sound wave generator (the sound wave generator 1A shown in FIG. 1) without the later-described heat pulse-generating layer 16 has the heat-insulating layer 12 composed of a material that generates heat by such a laser or infrared light.

Figure 4:
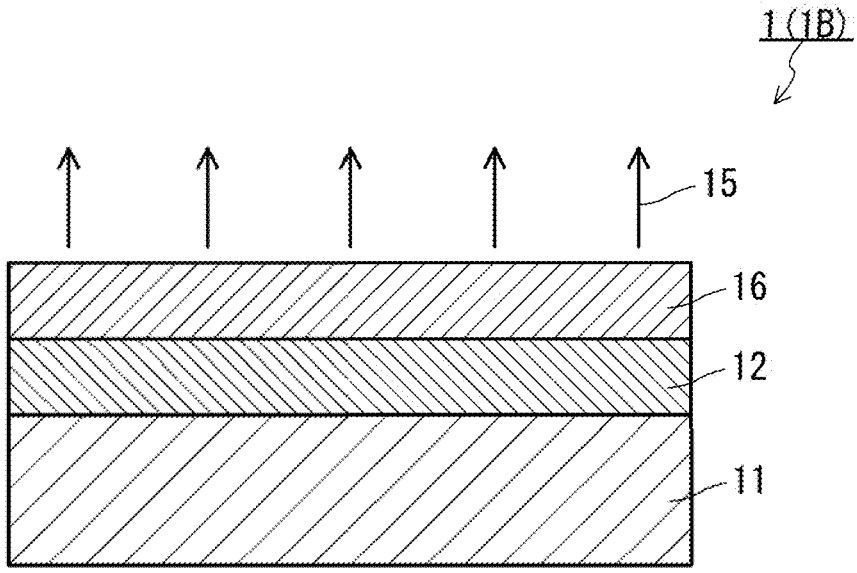
FIG. 4 is a sectional view schematically showing another example of the sound wave generator of the present invention.

The heat pulse source 13, for example, includes a heat pulse-generating layer (heat-generating layer) that is disposed on the surface of the heat-insulating layer 12 opposite to the base layer 11 and applies heat pulses to the heat-insulating layer 12. FIG. 4 shows a sound wave generator 1 (1B) of the present invention that has such a configuration. The sound wave generator 1B shown in FIG. 4 includes a heat pulse-generating layer 16 as mentioned above. The heat pulse-generating layer 16 is integrated with the base layer 11 and the heat-insulating layer 12. The sound wave generator 1B provided with the heat pulse-generating layer 16 has higher efficiency of heat to be applied to the heat-insulating layer 12 by the heat pulse source 13, compared to the sound wave generator 1A shown in FIG. 1.

The heat pulse-generating layer 16, for example, is a layer that generates heat pulses due to the energy of laser or infrared light that has been irradiated by the laser irradiation device or the infrared irradiation device provided in the heat pulse source 13. This heat pulse-generating layer 16 is composed of a material that generates heat due to laser or infrared light.

Figure 5:
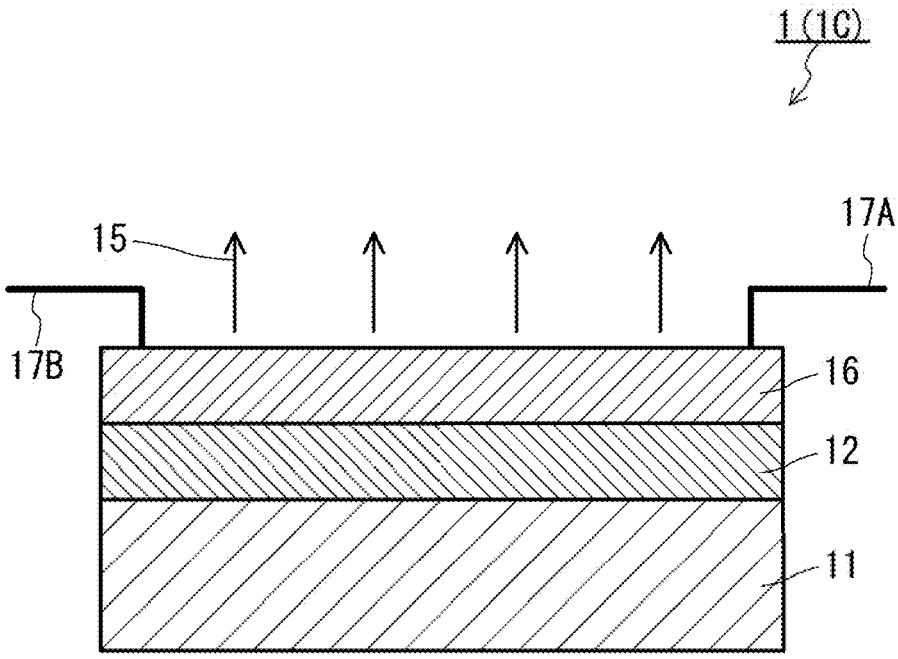
FIG. 5 is a sectional view schematically showing still another example of the sound wave generator of the present invention.

The heat pulse-generating layer 16, for example, is an electric heating layer that generates heat pulses using a pulse current or a pulse voltage (hereinafter, the two are collectively referred to as "electrical pulses") to be supplied to the layer. As is a sound wave generator 1 (1C) shown in FIG. 5, the heat pulse source 13 may be further provided with electric power supply lines 17A and 17B that supply electrical pulses to the heat pulse-generating layer (electric heating layer) 16. The sound wave generator 1C provided with the heat pulse source 13 as mentioned above can control the generation of the sound waves 15 by controlling the electrical pulses to be supplied to the heat pulse-generating layer 16, and therefore has excellent control properties. In addition to this, the sound wave generator 1C has high efficiency of heat to be applied to the heat-insulating layer 12, which further enhances the sound wave output properties thereof.

The heat pulse-generating layer 16 that generates heat pulses using electrical pulses is preferably composed of a resistance material that allows the desired heat generation to be obtained by application of electric power. Such a material, for example, is carbon material. More specifically, it is a carbon material obtained by heat-treating an organic material, for example. The electrical resistivity of the material is preferably 10 Ω/square to 10 kΩ/square.

The thickness of the heat pulse-generating layer 16 is not specifically limited.

The electric power supply lines 17A and 17B are generally composed of a material that has an electrical conductivity.

In the heat pulse source 13, the form of the heat pulse-generating layer 16, the form of the electric power supply lines 17A and 17B, the electrical connection state between the heat pulse-generating layer 16 and the electric power supply lines 17A and 17B are not specifically limited.

Figure 6:
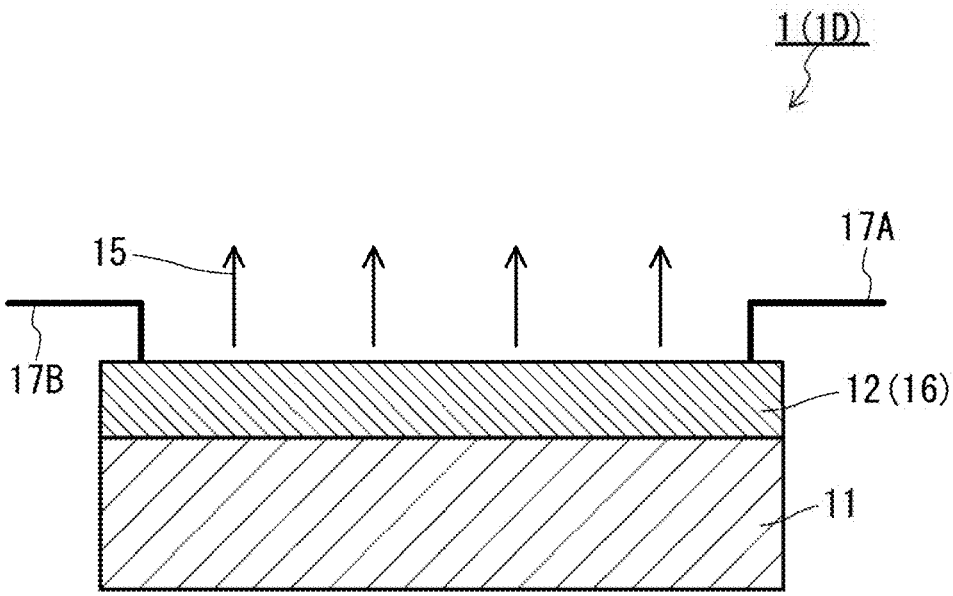
FIG. 6 is a sectional view schematically showing further another example of the sound wave generator of the present invention.

When the heat-insulating layer 12 has an electrical resistivity that allows the heat-insulating layer 12 to function as an electric heating layer upon the supply of electrical pulses, the heat-insulating layer 12 may serve both as a heat-insulating layer and a heat pulse-generating layer. FIG. 6 shows the sound wave generator of the present invention provided with such heat-insulating layer 12. A sound wave generator 1 (1D) shown in FIG. 6 has the heat-insulating layer 12 to which the electric power supply lines 17A and 17B are electrically connected, and thus the heat-insulating layer 12 functions also as the heat pulse-generating layer 16. This heat-insulating layer 12 is composed, for example, of crystalline fine particles containing germanium that have been subjected to heat treatment in a particular temperature range.

The sound wave generator of the present invention in which the heat pulse source includes the heat pulse-generating layer (heat-generating layer) disposed on the surface of the heat-insulating layer opposite to the base layer, and the heat pulse-generating layer is the electric heating layer that generates heat pulses using electrical pulses supplied to the heat pulse-generating layer shows an output coefficient (output sound pressure per unit of applied electric power) of 0.1 Pa/W or more, further 0.2 Pa/W or more, and 0.5 Pa/W or more, depending on its configuration. Such high output coefficient makes it feasible to use the sound wave generator of the present invention as an ultrasound source for object detection, particularly a small and power saving (for example, with a driving power of 1 W or less) ultrasound source. According to the ultrasound source, for example, an object detection sensor that detects the distance and location of the object can be achieved. In the object detection sensor, an object at a distance of about several tens cm to several m is irradiated with ultrasound, and the reflected sound waves are detected with a high-sensitivity microphone.

Figure 7:
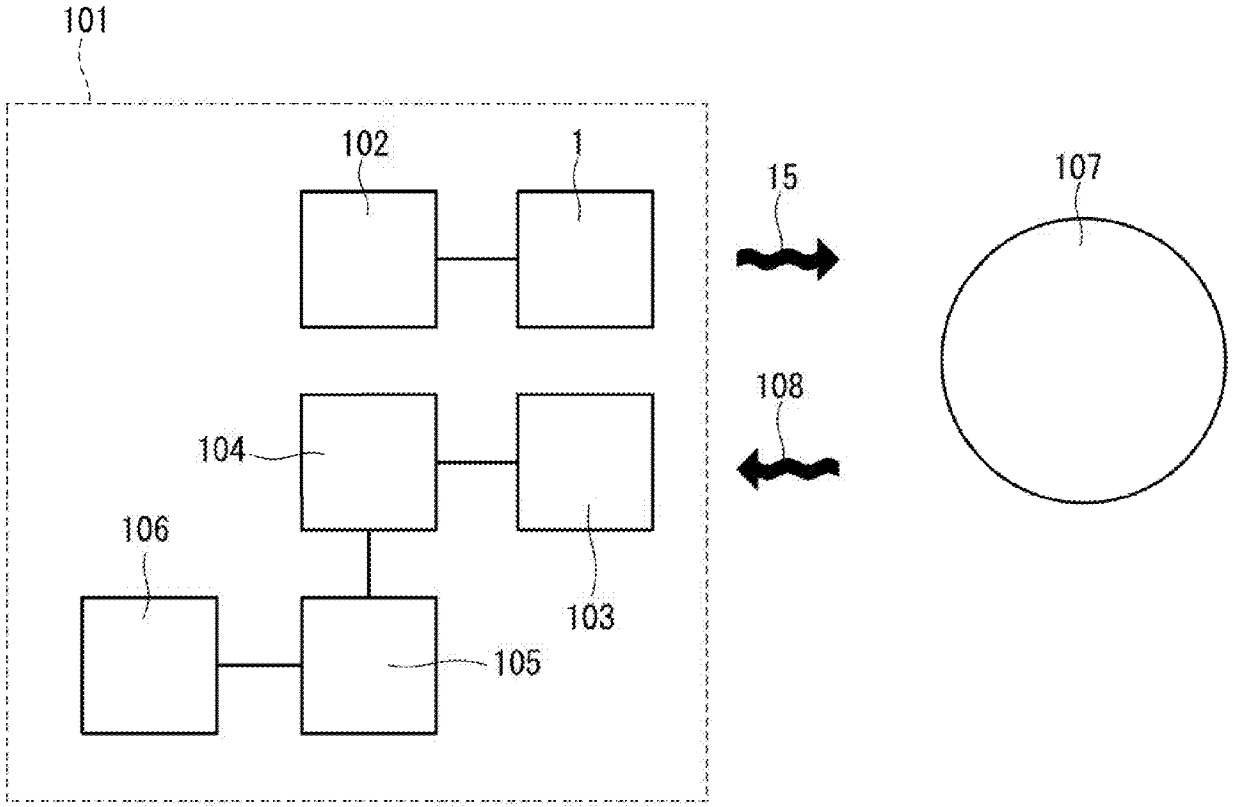
FIG. 7 is a schematic diagram showing an example of the configuration of an object detection sensor using the sound wave generator of the present invention.

FIG. 7 shows an example of the configuration of such an object detection sensor. An object detection sensor 101 shown in FIG. 7 includes the sound wave generator 1 of the present invention, a drive circuit 102 that supplies electrical pulses to the sound wave generator 1, a sound collecting microphone 103, an output signal amplifier 104 connected to the sound collecting microphone 103, an A/D converter 105, and a computing device 106. In the object detection sensor 101, electrical pulses are applied from the drive circuit 102 to the sound wave generator 1, thereby allowing the sound waves 15 to be generated from the sound wave generator 1. It is preferable that the sound waves 15 be ultrasound, for detecting the distance and location of an object 107. The sound waves 15 emitted from the sound wave generator 1 are reflected on the object 107, and reflected waves 108 return to the object detection sensor 101. The reflected waves 108 are converted into electrical signals by the sound collecting microphone 103. After being conducted through the output signal amplifier 104 and the A/D converter 105, the electrical signals are processed by the computing device 106, so that the distance and location of the object 107 with respect to the object detection sensor 101 are determined. The sound wave generator 1 of the present invention has high output properties, and the object detection sensor 101 therefore has high sensitivity.

Use of the sound wave generator of the present invention is not limited to an object detection sensor, and the sound wave generator of the present invention can be applied to conventional arbitrary devices provided with a sound wave generator.

Figure 8A:
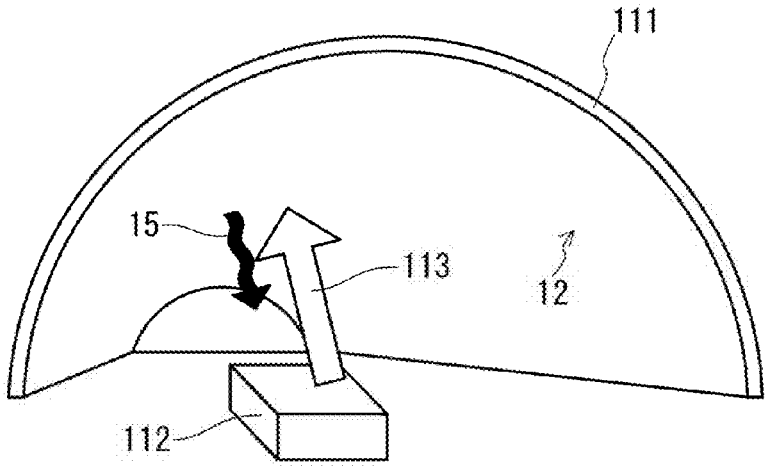
FIG. 8A is a schematic diagram showing an example of non-destructive testing for walls, to which the sound wave generator of the present invention is applied.

In the sound wave generator of the present invention, the base layer may have any form. Therefore, the sound wave generator of the present invention can be applied to non-destructive testing of walls, for example. FIG. 8A shows an example of a method for performing non-destructive testing of walls to which the sound wave generator of the present invention is applied. In the example shown in FIG. 8A, a base layer (not shown) and the heat-insulating layer 12 are disposed in contact with a surface to be subjected to inspection in a wall 111. The heat-insulating layer 12 is exposed, and the base layer is interposed between the wall 111 and the heat-insulating layer 12. The above-mentioned base layer can be formed, for example, by stacking a graphite sheet on the surface to be subject to inspection in the wall 111. The heat-insulating layer 12 on the base layer can be formed, for example, by laminating, to the base layer, the heat-insulating layer 12 that has been independently formed. Then, heat pulses are applied to the heat-insulating layer 12 from a unit 112 provided with a heat pulse source and a sound wave detecting part. Heat pulses are applied to the heat-insulating layer 12, for example, by a laser, infrared light, and microwave. As heat pulses are applied, the sound waves 15 are emitted by the heat-insulating layer 12, and the emitted sound waves 15 are measured by the sound wave detecting part of the unit 112. The sound waves 15 include information on the surface and inside of the wall 111. Examples of such information include the history of the wall 111, the structure of the material constituting the wall 111, and the damage present on the wall 111.

Figure 8B:
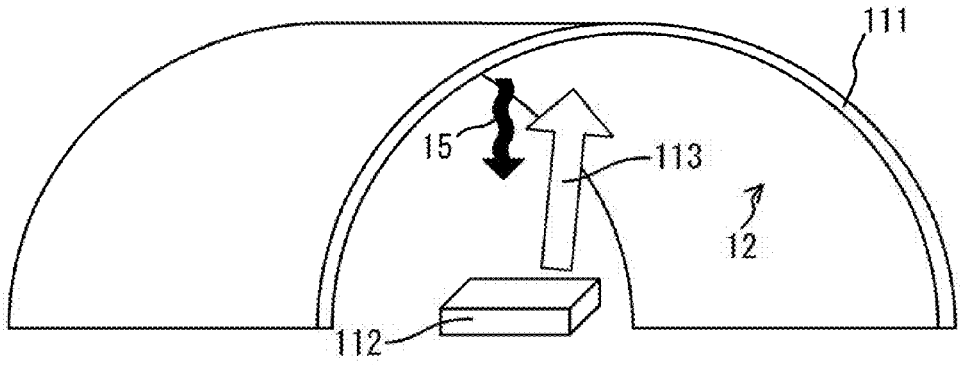
FIG. 8B is a schematic diagram showing another example of non-destructive testing for walls, to which the sound wave generator of the present invention is applied.

The form of the wall 111 is not limited, and the wall 111 may have the form shown in FIG. 8B, for example. The configuration shown in FIG. 8B is the same as the configuration shown in FIG. 8A except that the form of the wall 111 is different.

The following Table 1 shows the thermophysical parameter of each material.

TABLE 1

| | THERMAL CONDUCTIVITY α [W/mK] | HEAT CAPACITY C [$10^6$ J/m$^3$K] | αC [$10^6$ J$^2$/m$^4$K$^2$s] |
|---|---|---|---|
| DIAMOND | 1500 | 1.77 | 2655 |
| GRAPHITE | 600 | 1.60 | 960 |
| SILICON | 168 | 1.67 | 281 |
| GERMANIUM | 67 | 1.7 | 114 |
| SAPPHIRE | 42 | 3 | 126 |
| TITANIUM OXIDE ($TiO_2$) | 8.3 | 3 | 25 |

According to the techniques disclosed in JP 3845077 B2 and JP 3808493 B2, the material with the highest αC is optimal as a base layer among the materials listed in Table 1. That is, according to these techniques, diamond is optimal as a base layer, graphite that has a lower αC than diamond is inferior to diamond, and sapphire that has a very low αC is unsuitable as a base layer. However, according to the study by the inventor, a sound wave generator having far higher output properties can be achieved by a base layer composed of sapphire or graphite in combination with a heat-insulating layer composed of crystalline fine particles containing silicon or germanium, compared to a base layer composed of diamond. Further, depending on the circumstances, higher output properties can be achieved in the case of using a base layer composed of sapphire with a relatively low αC than in the case of using a base layer composed of graphite with a relatively high αC. The sound wave generator of the present invention as described above cannot be conceived from conventional techniques represented by the techniques disclosed in JP 3845077 B2 and JP 3808493 B2.

The inventor presumes that the binding interface between the graphite or sapphire that constitutes the base layer and the crystalline fine particles containing silicon or germanium that constitute the heat-insulating layer is in a suitable state for the sound wave generation of thermal excitation type in the sound wave generator of the present invention. In a heat-insulating layer composed of nanometer-size fine particles, as is the sound wave generator of the present invention, the state of heat flow in the heat-insulating layer is very complex. The practical suitability of such a complex heat flow state for the sound wave generation of thermal excitation type cannot be determined only by the thermophysical parameter αC of the heat-insulating layer and the thermal contrast between the heat-insulating layer and the base layer. It is assumed that the suitability of the heat flow state for the sound wave generation of thermal excitation type depends on the binding state between the fine particles constituting the heat-insulating layer and the binding state between the base layer and the fine particles. In addition to this, in the sound wave generator of the present invention, there is a possibility that a heat flow state that is further suitable for the sound wave generation of thermal excitation type is achieved by binding via an oxide film ($SiO_2$ or $GeO_2$ film) between the fine particles constituting the heat-insulating layer as well as between the base layer and the fine particles.

For example, in the case of a base layer composed of sapphire, the binding between the base layer and the fine particles constituting the heat-insulating layer is as follows. The surface energy ΔE of a material is proportional to the electronegativity difference ($\Delta_\chi$) of each element that constitutes the material. $\Delta_\chi$ between Si—O in a silicon oxide film is 1.54. $\Delta_\chi$ between Ge—O in a germanium oxide film is 1.43. On the other hand, $\Delta_\chi$ between Al—O in sapphire is 1.83, which is larger than the $\Delta_\chi$ between Si—O and the $\Delta_\chi$ between Ge—O. This allows a heat flow state suitable for the sound wave generation of thermal excitation type to be achieved between the base layer and the heat-insulating layer.

On the other hand, in the case of the base layer composed of graphite, the binding between the base layer and the fine particles constituting the heat-insulating layer is as follows. C—H bonds and C—OH bonds are present on the surface of graphite other than simple C—C bonds (most of the C—H bonds and C—OH bonds are found mainly in the crystal grain boundaries of graphite). For this reason, bonds of carbon, oxygen, and silicon or germanium, such as C—O—Si or C—O—Ge, are formed with the silicon oxide film or the germanium oxide film, and a strong binding is formed between the base layer and the fine particles constituting the heat-insulating layer. Further, this strong binding causes the distance between the base layer and the fine particles to be shortened, which strengthens the van der Waals force that acts between the base layer and the fine particles. This enhanced van der Waals force itself also promotes the formation of the strong binding between the base layer and the fine particles. This allows the heat flow state suitable for the sound wave generation of thermal excitation type to be achieved between the base layer and the heat-insulating layer.

According to Table 1, the thermophysical parameter αC of sapphire is lower than the thermophysical parameters αC of silicon and germanium. However, the relationship of the thermal conductivity between the base layer and the heat-insulating layer in the sound wave generator of the present invention is preferably such that the thermal conductivity of the base layer is relatively high and the thermal conductivity of the heat-insulating layer is relatively low, as in the conventional sound wave generators. This relationship is based on the fact that the heat-insulating layer is composed of fine particles.

<Production Method of Sound Wave Generator of Present Invention>

Figure 9:
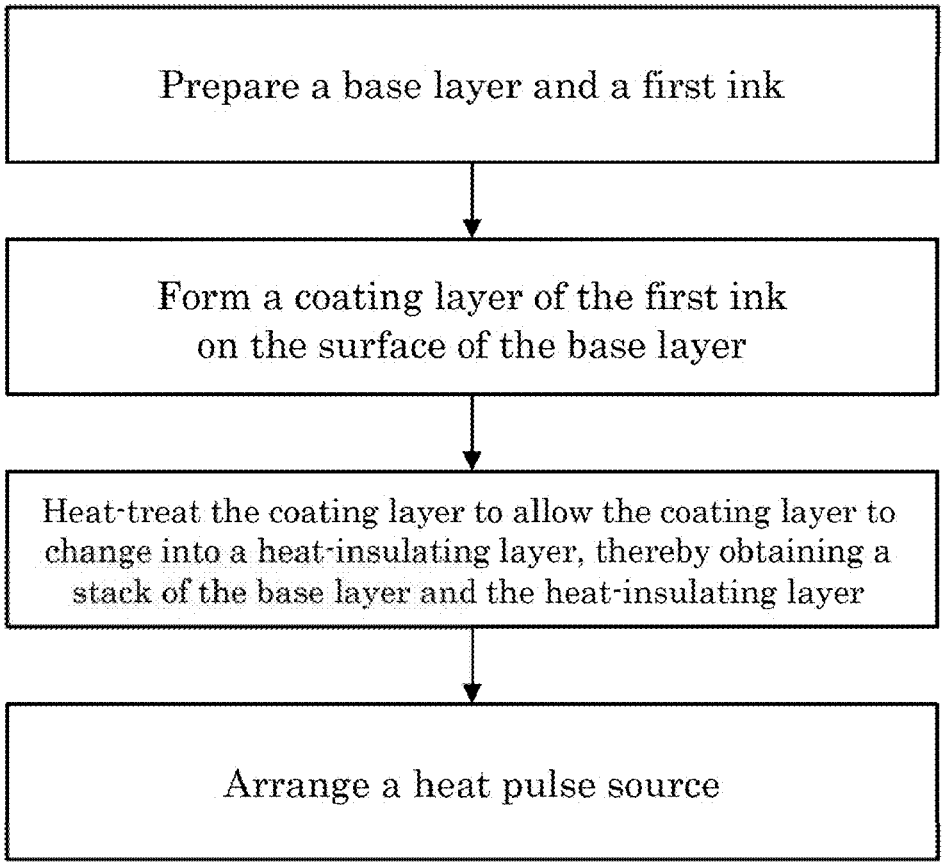
FIG. 9 is a flow chart showing an example of the production method of the sound wave generator of the present invention.

FIG. 9 shows an example of the production method of the present invention. In the production method shown in FIG. 9, a base layer and a first ink are prepared first. The base layer is composed of graphite or sapphire. The first ink is a solution in which crystalline fine particles containing silicon or germanium are dispersed. The first ink is used for forming a heat-insulating layer on the base layer.

The average particle size of the crystalline fine particles is typically at least 10 nm but not more than 0.5 μm as mentioned above. In addition to this, the values from D10 to D90 in the particle size distribution of the fine particles preferably fall within the range of at least 10 nm but not more than 0.5 μm. The fine particles can be obtained, for example, by grinding a silicon crystal or a germanium crystal, which is preferably a single crystal. The solvent for the first ink is not limited. The solvent typically is an organic solvent. The solvent is preferably at least one selected from acetone, ethanol, methanol, benzene, hexane, pentane, and isopropyl alcohol (IPA), particularly preferably IPA. Such a solvent has a low surface tension and has high wettability to the surface of the base layer composed of graphite or sapphire. The use of the solvent that has high wettability allows the state of heat flow between the base layer and the heat-insulating layer formed of the first ink to be suitable for the sound wave generation of thermal induction type. It should be noted that C—H bonds and C—OH bonds that are present on the surface of the base layer composed of graphite contribute to the enhancement of the wettability between the base layer and the first ink.

Next, the first ink is applied to the surface of the base layer, so that a coating layer of the first ink is formed on the surface of the base layer. The method for forming the coating layer is not specifically limited. For example, spin coating and die coating can be used.

Next, the whole is heat-treated at 100 to 1000° C., so that a heat-insulating layer is formed from the coating layer of the first ink. Thus, a stack of the base layer and the heat-insulating layer disposed on the base layer is obtained (the process up to here is the first step). The heat treatment temperature is adjusted depending on the type of the fine particles contained in the first ink. In the case where the fine particles are crystalline fine particles containing silicon, the heat treatment temperature is preferably 550 to 900° C. In the case where the fine particles are crystalline fine particles containing germanium, the heat treatment temperature is preferably 250 to 600° C. The method for the heat treatment is not specifically limited. For example, the whole of the base layer and the coating layer may be placed in a furnace that has been maintained at the heat treatment temperature. The heat treatment may include two or more heat treatment steps in each of which the heat treatment temperature and/or heat treatment atmosphere is different from those in others.

Next, a heat pulse source is provided so as to be capable of applying heat pulses to the heat-insulating layer (the second step). Thus, the sound wave generator of the present invention is produced. The heat pulse source may be provided so as to be capable of applying heat pulses to the heat-insulating layer from the surface of the heat-insulating layer opposite to the base layer, for example.

In the case where the heat pulse source in the sound wave generator of the present invention includes a heat pulse-generating layer (heat-generating layer) that is disposed on the surface of the heat-insulating layer opposite to the base layer and applies heat pulses to the heat-insulating layer, and the heat pulse-generating layer is composed of carbon material, the second step may be the following step A. In the step A, a coating layer of a precursor solution (the second ink) that turns into a carbon material by heat treatment is formed on the surface of the heat-insulating layer opposite to the base layer that has been formed in the first step, and the formed coating layer is heat-treated, so that the heat pulse-generating layer is formed.

Figure 10:
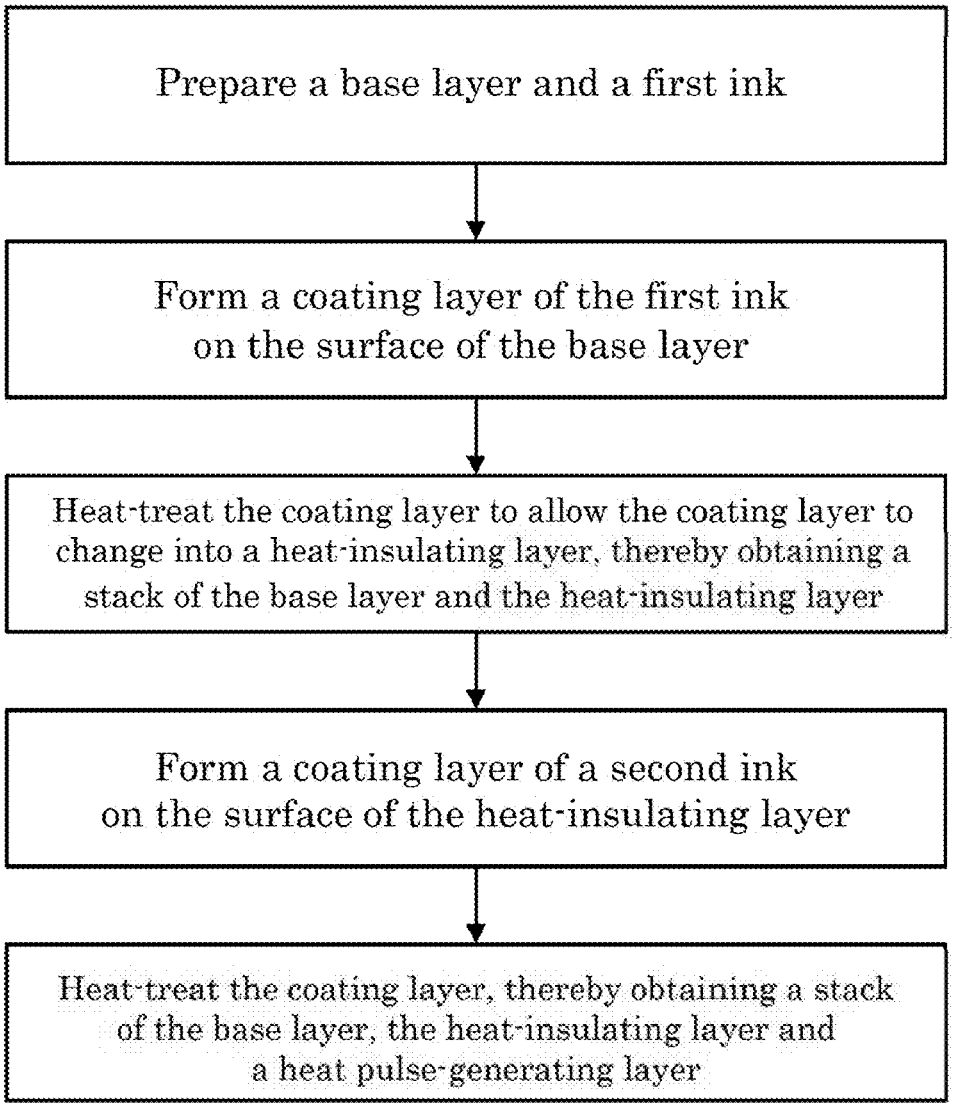
FIG. 10 is a flow chart showing another example of the production method of the sound wave generator of the present invention.

FIG. 10 shows an example of the production method of the present invention that includes this second step. In the method shown in FIG. 10, the process up to the point at which a stack of the base layer and the heat-insulating layer is obtained is the same as in the method shown in FIG. 9. In the method shown in FIG. 10, a second ink is applied to the surface of the formed heat-insulating layer subsequently to this, so that a coating layer of the second ink is formed on the surface of the heat-insulating layer. The method for forming the coating layer is not specifically limited. For example, spin coating and die coating can be used.

The second ink is not limited as long as a heat pulse-generating layer composed of carbon material is formed by heat treatment, and typically contains an organic component such as turpentine oil, and butyl acetate.

Next, the whole is heat-treated at 100 to 1000° C., so that a heat pulse-generating layer is formed from the coating layer of the second ink. Thus, the sound wave generator of the present invention including the base layer, the heat-insulating layer and the heat pulse-generating layer is produced.

The heat treatment temperature is adjusted depending on the type of the components contained in the second ink. The heat treatment may include two or more heat treatment steps in each of which the heat treatment temperature and/or heat treatment atmosphere is different from those in others. The method for the heat treatment is not specifically limited. For example, the whole of the base layer, the heat-insulating layer and the coating layer of the second ink may be placed in a furnace that has been maintained at the heat treatment temperature.

The heat pulse-generating layer that is formed by application and heat treatment of the second ink is made of tarry material that contains a carbon material such as carbon black. Such a material has excellent heat resistance. Therefore, during operation of the sound wave generator of the present invention, the heat pulse-generating layer stably exhibits its function. In addition to this, with the elapse of time of use as a heat-generating layer, the amount of nitrogen and oxygen contained therein immediately after the formation gradually decreases, which enhances the stability as the heat pulse-generating layer more and more. This decrease in the amount of nitrogen and oxygen can be confirmed by energy dispersive X-ray spectroscopy (EDX). It is preferable that the heat pulse-generating layer be a layer that functions as a heat pulse-generating layer by application of electrical pulses to the layer, that is, an electric heating layer.

<Method for Generating Sound Waves of Present Invention>

The method for generating sound waves of the present invention is a method for generating sound waves using the above-mentioned sound wave generator of the present invention. Specifically, in the sound wave generator of the present invention, heat pulses are applied to the heat-insulating layer by the heat pulse source, so that sound waves are generated.

The configuration of the sound wave generator is as mentioned above.

In the sound wave generator, it is preferable that the heat pulse source include the heat pulse-generating layer that is disposed on the surface of the heat-insulating layer opposite to the base layer and applies heat pulses to the heat-insulating layer. In this case, heat pulses are applied to the heat-insulating layer by the heat pulse-generating layer, so that sound waves are generated.

It is further preferable in this case that the heat pulse-generating layer be an electric heating layer that generates heat pulses using a pulse current or a pulse voltage to be supplied to the heat pulse-generating layer, and the heat pulse source further include electric power supply lines that supply the pulse current or the pulse voltage to the electric heating layer. Here, the pulse current or the pulse voltage is supplied to the electric heating layer via the electric power supply lines, thereby causing heat pulses to be generated in the heat pulse-generating layer. Then, the generated heat pulses are applied to the heat-insulating layer, so that sound waves are generated.

The method for generating sound waves of the present invention can be widely applied to conventional devices and methods that use sound waves.

EXAMPLES

Hereinafter, the present invention is described in detail with reference to examples. The present invention is not limited to the following examples.

Example 1

A sound wave generator having a heat-insulating layer composed of crystalline silicon fine particles was produced in Example 1. Then, the combination of the heat-insulating layer and a base layer was examined by changing the material constituting the base layer. In addition to this, a sound wave generator having a heat-insulating layer composed of crystalline $TiO_2$ (titanium oxide) fine particles was produced and examination was performed in the same manner.

The sound wave generator used for the examination was produced as follows in accordance with the production method shown in FIG. 10. First, four types of base layers formed of graphite, sapphire, diamond or silicon were prepared. EYGS091203 manufactured by Panasonic Corporation was used as graphite. The thickness of the graphite base layer was set to 200 μm, and the thickness of the other three types of the base layers was set to 500 μm. Next, a dispersion of the crystalline silicon fine particles or a dispersion of the crystalline $TiO_2$ fine particles was applied to the surface of each base layer by spin coating. Thus, a coating layer of the dispersion was formed. Spin coating was performed in a closed container maintained in an air atmosphere and at room temperature (25° C.) and the conditions thereof were set to a rotation speed of 500 rpm for 5 seconds, and subsequently a rotation speed of 8000 rpm for 60 seconds. Next, the base layer on the surface of which the coating layer was formed was heated at 100° C. under nitrogen flow to dry the coating layer. Thereafter, it was further heat-treated at 800° C. under hydrogen flow (in the case of silicon fine particles) or at 500° C. under argon flow (in the case of $TiO_2$ fine particles). Thus, a stack in which the base layer and the heat-insulating layer composed of the above-mentioned silicon fine particles or $TiO_2$ fine particles were integrated was obtained. Most part of the solvent included in the dispersion was removed by the heating at 100° C. under nitrogen flow. Residual organic substances were removed and the binding between the fine particles and the binding with the base layer due to heat were strengthened by the heat treatment at 800° C. under hydrogen flow (or the heat treatment at 500° C. under argon flow).

An IPA dispersion of crystalline silicon fine particles that were in the form of flakes (manufactured by Primet Precision Materials, Inc., with a content of silicon fine particles of 8.5 wt %) was used as a dispersion of silicon fine particles. In this example, this silicon fine particles may be referred to as "Si (Lot#1)".

An IPA dispersion of crystalline $TiO_2$ fine particles that were in the form of spheres (manufactured by C. I. Kasei Company, Limited, with a content of $TiO_2$ fine particles of 15.4 wt %) was used as a dispersion of $TiO_2$ fine particles. In this example, this $TiO_2$ fine particles may be referred to as "$TiO_2$ (Lot#1)".

In order to select a suitable method for determining the particle size of the fine particles, the particle size distribution of the silicon fine particles in the dispersion was first determined using a particle size distribution analyzer. The particle size distribution of the silicon fine particles, as determined using an ultrasonic particle size distribution analyzer, showed a maximum value in the range of 8 nm (D10) to 156 nm (D90). The median of the particle size distribution as an example was 57 nm. On the other hand, the particle size distribution of the silicon fine particles, as determined using a laser diffraction/scattering particle size distribution analyzer, showed a maximum value in the range of 100 nm (D10) to 300 nm (D90). The median of the particle size distribution as an example was 167 nm. Particle size analyses using a general particle size distribution analyzer are performed for particle models in the form of spheres, and thus do not depend on whether the ultrasonic type or the laser diffraction/scattering type is employed. However, in the laser diffraction/scattering type, the particle size distribution is estimated from the cross-sectional area of the laser light scattering. This is probably the reason why the determined value using the laser diffraction/scattering type was higher than the determined value using the ultrasonic type, as determined for flat particles, such as the particles in the form of flakes. In view of this, the particle size distribution of fine particles, such as silicon fine particles, constituting the heat-insulating layer was determined by image analysis of a scanning electron microscope (SEM) image of the cross section (cross section perpendicular to the main surface of the layer) of the formed heat-insulating layer in this example. In addition, the structure of the heat-insulating layer also was determined thereby.

Figure 11:
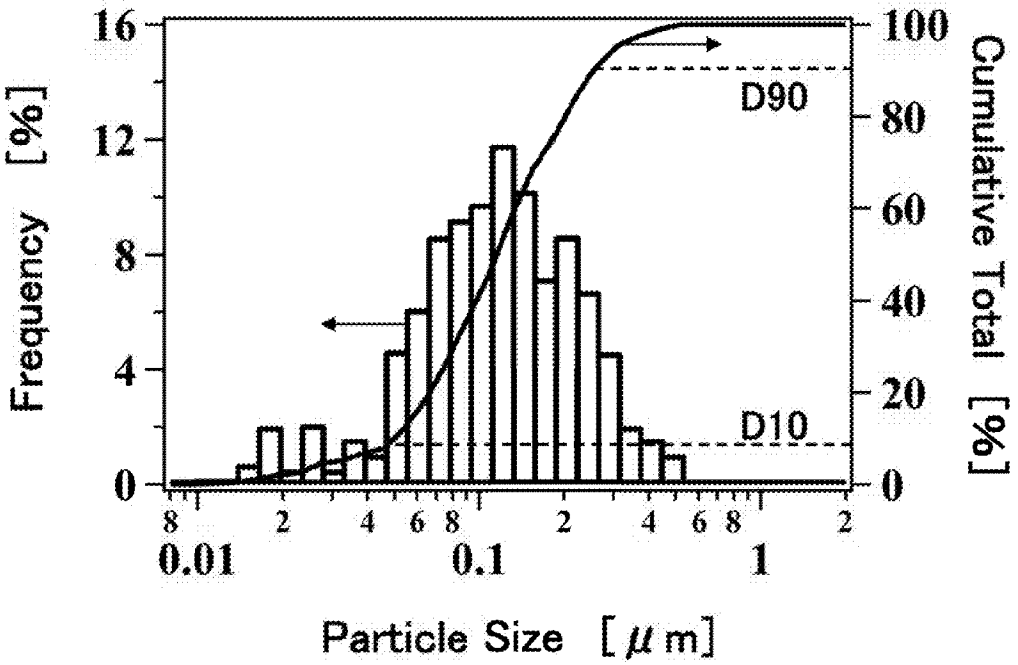
FIG. 11 is a graph showing the determination results of the particle size distribution for the silicon fine particles used in Example 1.

The form and the particle size distribution of silicon fine particles (Si (Lot#1)) and $TiO_2$ fine particles ($TiO_2$ (Lot#1)) in the above-produced heat-insulating layer were determined by image analysis of the SEM image. As a result, the silicon fine particles were in the form of flakes, and in the particle size distribution, D10 was 50 nm, D90 was 254 nm, and the median was about 115 nm. FIG. 11 shows the determination results of the particle size distribution for the silicon fine particles (Si (Lot#1)). On the other hand, $TiO_2$ fine particles were in the form of spheres, and in the particle size distribution, D10 was 20 nm, D90 was 100 nm, and the median was 40 nm. In the particle size distribution of the $TiO_2$ fine particles in the dispersion as determined using an ultrasonic particle size distribution analyzer, the median was 36 nm.

Observation using a high resolution SEM or a transmission electron microscope (TEM) independently demonstrated that the fine particles of each type in the produced heat-insulating layer were in a mixed state of primary particles and secondary particles formed by agglomeration of the primary particles. The above-mentioned particle size distribution obtained by image analysis of the SEM image was a particle size distribution including both the primary particles and the secondary particles because it was impossible to classify all the fine particles constituting the heat-insulating layer into the primary particles and the secondary particles.

Figure 13A:
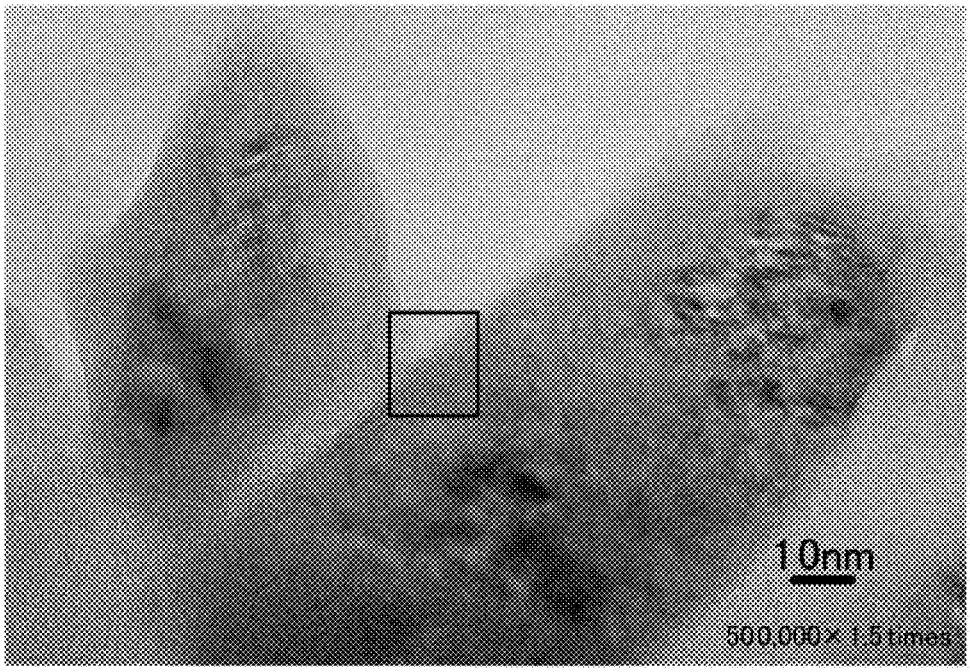
FIG. 13A is a view showing an SEM image of a binding portion between adjacent fine particles in the heat-insulating layer produced in Example 1.
Figure 13B:
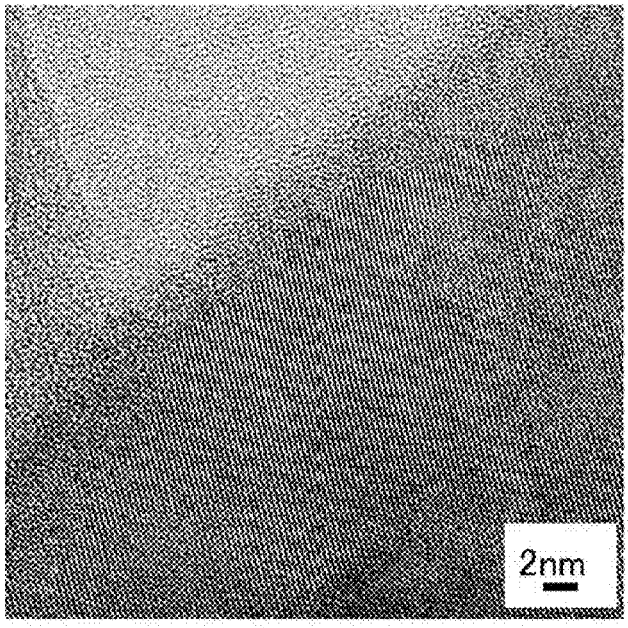
FIG. 13B is an enlarged view showing the inside of the frame in FIG. 13A.
Figure 13C:
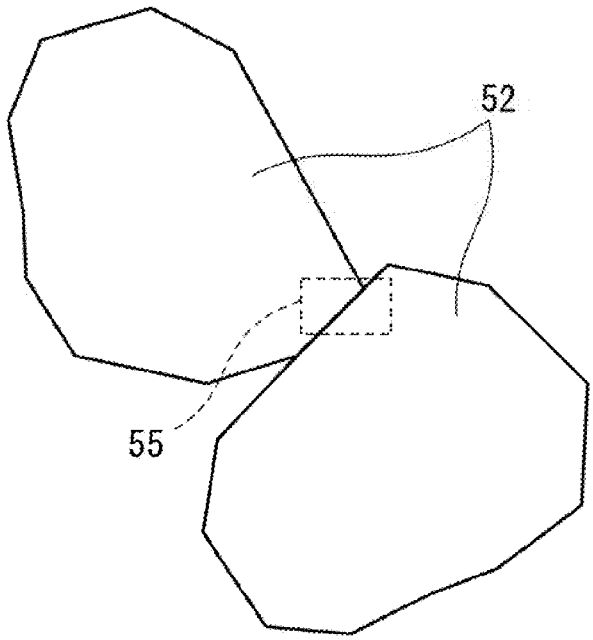
FIG. 13C is an illustration showing the binding state between the adjacent fine particles in the heat-insulating layer produced in Example 1.

In addition to this, the image analysis demonstrated that the heat-insulating layer composed of silicon fine particles had a peculiar structure shown in FIG. 12A and FIG. 12B. This structure showed the following specific features: comparatively large fine particles were mostly distributed in the lower portion (portion on the side of the base layer 11) of the heat-insulating layer 12, and comparatively small fine particles were mostly distributed in the upper portion (portion opposite to the base layer 11) thereof; the fine particles in the lower portion were mainly the secondary particles 52 formed by agglomeration of the primary particles 51, and the particles in the upper portion were mainly the primary particles 51 and the secondary particles 52 that were comparatively small; and adjacent fine particles were bound to each other at a binding portion with a very small area. The binding portion between the fine particles was independently observed using TEM. As a result, it was found that an oxide film ($SiO_2$ film) with a thickness of about 2 to 10 nm was present on an interface 55 that is the binding portion between the fine particles (secondary particles 52), and the fine particles were bound to each other through the oxide film, as shown in FIG. 13A to FIG. 13C. FIG. 13B is an enlarged view of a portion defined by the frame in FIG. 13A.

Independently of this, RBS (Rutherford backscattering) analysis was performed for the produced heat-insulating layer with the heat-insulating layer being etched from its upper portion, so that the void fraction of the heat-insulating layer was determined. In RBS analysis, the scattering cross section of the heat-insulating layer was estimated, which enabled the void fraction of the heat-insulating layer to be calculated. The void fraction of the heat-insulating layer was about 50% in its top portion and about 90% in its bottom portion, showing a tendency of gradual increase from the top portion toward the bottom portion.

Independently of these, the wide-angle X-ray diffraction (WAXD) profile and the Raman spectroscopy profile were determined for the produced heat-insulating layer. As a result, diffraction peaks were observed at diffraction angles 2θ of 28.5°, 47.3°, 56.1°, 69.1° and 76.4° in the WAXD profile of the heat-insulating layer composed of silicon fine particles, and a peak was observed at a Raman shift of 522 $cm^{-1}$ in the Raman spectroscopy profile thereof. These diffraction peaks and Raman shift were peaks and shift specific to silicon crystal. On the other hand, diffraction peaks were observed at diffraction angles 2θ of 25.3°, 37.8°, 48.1°, 55.1° and 75.0° in the WAXD profile of the heat-insulating layer composed of $TiO_2$ fine particles. These diffraction peaks were peaks specific to $TiO_2$ crystal. That is, it was confirmed that the produced heat-insulating layer was composed of crystalline silicon fine particles or crystalline $TiO_2$ fine particles.

Next, a precursor solution obtained by mixing turpentine oil, butyl acetate and ethyl acetate at a weight ratio of 6:3:1 was applied by spin coating to the exposed surface of the heat-insulating layer in the produced stack. Thus, a coating layer of the precursor solution was formed. The same conditions were employed for the spin coating as the conditions for the spin coating of the surface of the base layer with the dispersion of silicon fine particles or $TiO_2$ fine particles. Next, the stack formed with the coating layer was heated at 120° C. under nitrogen flow to dry the coating layer. Thereafter, it was further heat-treated at 800° C. under argon flow (in the case of the heat-insulating layer composed of silicon fine particles) or at 500° C. under argon flow (in the case of the heat-insulating layer composed of $TiO_2$ fine particles). Thus, the organic component in the precursor solution was changed into a carbon material. This allowed the base layer, the heat-insulating layer composed of silicon fine particles, and the heat-generating layer (heat pulse-generating layer) composed of carbon material to be integrated, so that a stack having a structure in which the heat-insulating layer was interposed between the base layer and the heat-generating layer was obtained. It was independently confirmed that the structure of the fine particles in the heat-insulating layer was maintained at such heat treatment temperature. The thickness of the heat-generating layer was set to 50 nm. It was independently confirmed that a sheet resistance of about 10Ω/square to 100 kΩ/square was achieved in the heat-generating layer with a thickness in the range of 20 nm to 1 μm.

Next, a pair of Pt (platinum) electrodes for applying electrical pulses to the heat-generating layer (electric heating layer) were provided by sputtering on the heat-generating layer in the produced stack. Thus, a sound wave generator was obtained. Each of the electrodes was in the form of a strip with a thickness of 0.3 μm, a width of 1 mm, and a length of 10 mm. The distance between the pair of electrodes was adjusted in the range of 1 to 20 mm, typically 5 mm. The electrodes for applying electrical pulses to the heat-generating layer is not limited to Pt, and may be composed of an arbitrary conductive material. However, since there is a material (for example, aluminium) in which an increase in contact resistance that is presumably caused by oxidation of electrodes is observed when the frequency of the electrical pulses is high, it is preferable to provide electrodes made of a material in which such increase is unlikely to occur, such as Pt, Ir (iridium) or ITO (indium tin oxide).

Table 2 below shows the configuration of the produced sound wave generator. The parenthesis number in each box of Table 2 denotes the thickness of each layer.

TABLE 2

| | BASE LAYER | HEAT-INSULTING LAYER | HEAT-GENERATING LAYER |
|---|---|---|---|
| Ex. 1-1 | GRAPHITE (200 μm) | Si (Lot#1) (750 nm) | CARBON MATERIAL (50 nm) |
| Ex. 1-2 | SAPPHIRE (500 μm) | Si (Lot#1) (750 nm) | CARBON MATERIAL (50 nm) |
| C. Ex. 1-A | DIAMOND (500 μm) | Si (Lot#1) (750 nm) | CARBON MATERIAL (50 nm) |
| C. Ex. 1-B | SILICON (500 μm) | Si (Lot#1) (750 nm) | CARBON MATERIAL (50 nm) |
| C. Ex. 1-C | GRAPHITE (200 μm) | $TiO_2$ (Lot#1) (700 nm) | CARBON MATERIAL (50 nm) |
| C. Ex. 1-D | SAPPHIRE (500 μm) | $TiO_2$ (Lot#1) (700 nm) | CARBON MATERIAL (50 nm) |
| C. Ex. 1-E | DIAMOND (500 μm) | $TiO_2$ (Lot#1) (700 nm) | CARBON MATERIAL (50 nm) |
| C. Ex. 1-F | SILICON (500 μm) | $TiO_2$ (Lot#1) (700 nm) | CARBON MATERIAL (50 nm) |

Figure 14:
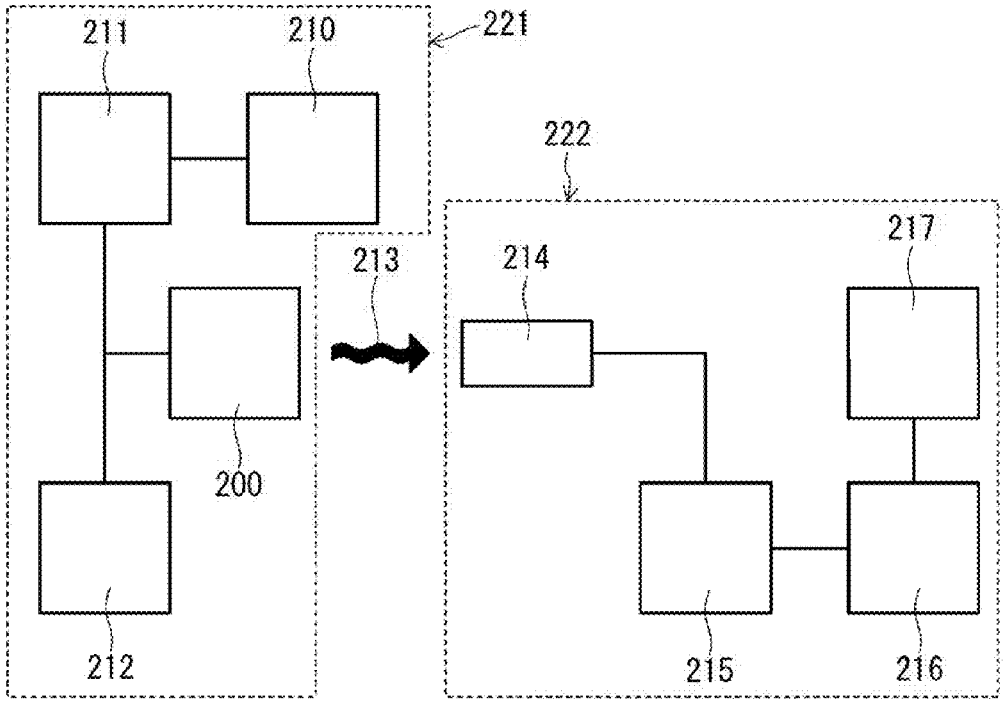
FIG. 14 is a schematic diagram illustrating a measurement system for evaluating the sound wave generator produced in Examples.

Next, the output properties of the produced sound wave generator were measured using the measurement system shown in FIG. 14. The system shown in FIG. 14 includes a sound emitting part 221 provided with a sound wave generator 200, and a sound collecting part 222 that collects sound waves 213 emitted from the sound wave generator 200 and analyze them. The sound emitting part 221 further includes a signal generator 210, an input signal amplifier 211, and a waveform analyzer 212. The signal generator 210 and the input signal amplifier 211 are connected to the sound wave generator 200 and apply electrical pulses to the heat-generating layer in the sound wave generator 200 for outputting sound waves. The waveform of the applied electrical pulses is measured by the waveform analyzer 212. The sound collecting part 222 includes a sound collecting microphone 214, an output signal amplifier 215, a filter (noise filter) 216, and a waveform analyzer 217. The sound waves 213 emitted by the sound wave generator 200 are converted into electrical signals by the sound collecting microphone 214. The signals are measured by the waveform analyzer 217 after passing through the output signal amplifier 215 and the filter 216. The measurement of the output properties of the sound wave generator was performed by setting the distance between the sound wave generator 200 and the sound collecting microphone 214 to 5 mm, in accordance with the description in The Society of Chemical Engineers, Japan, the 37th Annual Meeting in Autumn, symposium on <nanoprocessing>, proceedings D-307 (2005). The sound collecting microphone 214 used for the measurement was No. 4939 manufactured by Brüel & Kjær Sound & Vibration Measurement A/S (B&K).

Figure 15:
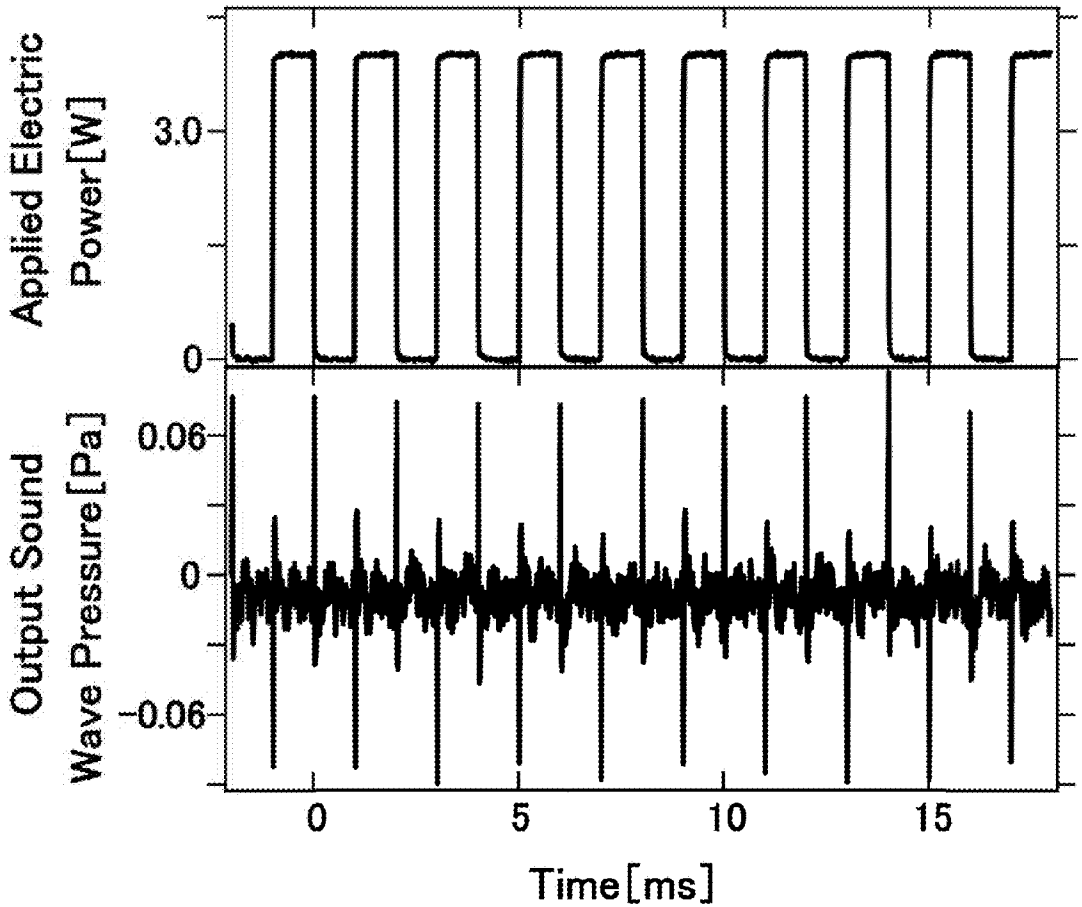
FIG. 15 is a graph showing the output properties of the sound wave generator (Example 1-1) of the present invention produced in Example 1.

FIG. 15 shows the measurement results for Example 1-1. The upper row in FIG. 15 shows the waveform of the electrical pulses applied to the heat-generating layer of Example 1-1. The lower row shows the waveform of the sound waves emitted by the sound wave generator as the waveform of sound pressure. The horizontal axis indicates the elapsed time from the start of application of electrical pulses in both rows. As shown in FIG. 15, upon application of electrical pulses having a rectangular waveform, emission of sound waves in the form of impulses with a frequency corresponding to the modulation of the electrical pulses was observed. The frequency was about 100 kHz (the half width of a pulse was about 10 μseconds). The sound waves were emitted at the time of application of large modulation bias such as a leading edge and a trailing edge of a rectangular pulse. On the other hand, sound waves were not emitted at the time of application of steady bias. This indicates that the sound wave generation mechanism in Example 1-1 is based on the sound wave generation of thermal induction type in which sound waves are generated due to the alternating current component in the applied heat pulses.

Figure 16:
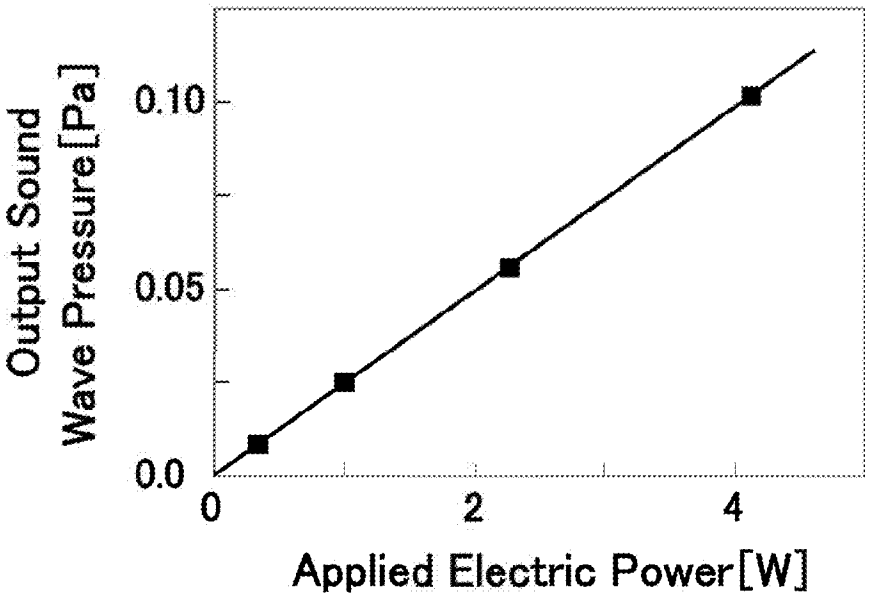
FIG. 16 is a graph showing the variation in the maximum sound pressure of the sound waves to be emitted from the sound wave generator (Example 1-1) of the present invention produced in Example 1 when the maximum value of the pulse voltage to be applied is varied in the sound wave generator.

Next, the variation of the maximum sound pressure of the sound waves emitted from Example 1-1 was determined with varying the maximum value of the electrical pulses to be applied to the heat-generating layer of Example 1-1. FIG. 16 shows the determination results. The horizontal axis in FIG. 16 indicates the electric power applied to Example 1-1. As shown in FIG. 16, the maximum sound pressure of the sound waves emitted from Example 1-1 was proportional to the applied electric power. In the sound wave generation mechanism based on mechanical vibration, it is known that the maximum sound pressure of the sound waves to be emitted is proportional to the "voltage" to be applied. On the other hand, in the sound wave generation mechanism based on thermal induction, it is known that the maximum sound pressure of the sound waves to be emitted is proportional to the "electric power" to be applied, that is, the square of the applied voltage. As shown in FIG. 16, the maximum sound pressure of the sound waves to be emitted is proportional to the applied electric power in Example 1-1, which indicates that the sound wave generation mechanism in Example 1-1 is based on the sound wave generation of thermal induction type.

Determination was performed in the same manner with varying the frequency of the electrical pulses to be applied in the range of 1 kHz to 100 kHz. Emission of sound waves in the form of impulses with a frequency corresponding to the frequency of the electrical pulses was observed, regardless of the frequency of the electrical pulses. In this Example, emission of sound waves up to the frequency of 100 kHz was observed because the bandwidth upper limit of the sound collecting microphone in the measurement system was 100 kHz. However, generation of sound waves with a still higher frequency can be expected as well.

Determination was performed in the same manner with varying the waveform of the electrical pulses to be applied. Emission of sound waves was observed as long as the applied electric power contained an alternating current component, regardless of the waveform of the electrical pulses.

The same waveform was obtained also for Example 1-2, though the maximum value of the output sound pressure was different.

Table 3 below shows the sound pressure (output sound pressure per unit of applied electric power) of the sound waves emitted by each of Examples and Comparative Examples shown in Table 2.

TABLE 3

| | BASE LAYER | HEAT-INSULTING LAYER | OUTPUT SOUND PRESSURE PER UNIT OF APPLIED ELECTRIC POWER ($\times 10^{-3}$ Pa/W) |
|---|---|---|---|
| Ex. 1-1 | GRAPHITE (200 μm) | Si (Lot#1) (750 nm) | 271 |
| Ex. 1-2 | SAPPHIRE (500 μm) | Si (Lot#1) (750 nm) | 113 |
| C. Ex. 1-A | DIAMOND (500 μm) | Si (Lot#1) (750 nm) | 40 |
| C. Ex. 1-B | SILICON (500 μm) | Si (Lot#1) (750 nm) | 0.6 |
| C. Ex. 1-C | GRAPHITE (200 μm) | $TiO_2$ (Lot#1) (700 nm) | 9 |
| C. Ex. 1-D | SAPPHIRE (500 μm) | $TiO_2$ (Lot#1) (700 nm) | SOUND WAVES NOT EMITTED |
| C. Ex. 1-E | DIAMOND (500 μm) | $TiO_2$ (Lot#1) (700 nm) | SOUND WAVES NOT EMITTED |
| C. Ex. 1-F | SILICON (500 μm) | $TiO_2$ (Lot#1) (700 nm) | SOUND WAVES NOT EMITTED |

As shown in Table 3, in the case of the heat-insulating layer composed of silicon fine particles, high output properties were achieved when sapphire that had a thermophysical parameter $\alpha C$ considerably lower than those of diamond (Comparative Example 1-A) and silicon (Comparative Example 1-B) was used for the base layer (Example 1-2). High output properties were achieved also when graphite was used for the base layer (Example 1-1). It was not until the combination of the base layer composed of sapphire or graphite and the heat-insulating layer composed of crystalline silicon fine particles was found to be optimal in this Example that such high output properties were achieved. Those skilled in the art never could expect or achieve the results of this Example based on conventional sound wave generators and the technical ideas thereof that disclose a technique for increasing the thermal contrast between the base layer and the heat-insulating layer as much as possible. This is obvious also from the fact that the thermal contrast between the base layer and the heat-insulating layer in Example 1-2 as approximated based on Formula (3) and Table 1 in Nature, vol. 400, pp. 853-855, 26 Aug. 1999, from the sound pressure that had been determined in Example 1-2 was far from reaching 1/100 in terms of $\alpha_1 C_1/\alpha_s C_s$ in JP 3808493 B2 (far larger than 1/100).

On the other hand, according to the conventional sound wave generators and the technical ideas thereof, in the case of the heat-insulating layer composed of $TiO_2$ fine particles are expected to show higher output properties compared to the heat-insulating layer composed of silicon fine particles. This is because the thermophysical parameter $\alpha C$ of $TiO_2$ is very low and thus the thermal contrast between the base layer and the heat-insulating layer is very high. However, as shown in Table 3, in the cases (Comparative Examples 1-C to 1-F) of the heat-insulating layer composed of $TiO_2$ fine particles, sound waves were hardly emitted in combination of any base layer. This also indicates that the results of this Example cannot be achieved based on the conventional sound wave generators and the technical ideas thereof.

The output properties of the sound waves to be emitted were measured with varying the thickness of the heat-insulating layer in Examples 1-1 and 1-2. It was confirmed that the thickness of the heat-insulating layer was preferably at least 10 nm and less than 50 μm, more preferably at least 50 nm but not more than 10 μm.

The output properties of the sound waves to be emitted were measured with varying the thickness of the heat-insulating layer in Comparative Examples 1-B to 1-F. Even if the thickness of the heat-insulating layer was varied, the situation in which sound waves were hardly emitted remained the same.

In each of Examples and Comparative Examples, measurement was performed in the same manner by setting the distance between the sound wave generator 200 and the sound collecting microphone 214 to 10 mm in the measurement system shown in FIG. 14. The results showing the same tendency as in the case of the distance set to 5 mm was obtained.

Example 2

In Example 2, a sound wave generator having a heat-insulating layer composed of crystalline germanium fine particles was produced. Then, the combination of the heat-insulating layer and a base layer was examined with changing the material constituting the base layer.

The sound wave generator used for the examination was produced in the same manner as in each of Examples and Comparative Examples in Example 1 except that a dispersion of crystalline germanium fine particles was used instead of the dispersion of crystalline silicon fine particles, and the heat treatment temperature was changed from 800° C., which was employed for silicon fine particles, to 400° C.

An IPA dispersion of crystalline germanium fine particles that were in the form of flakes (manufactured by Primet Precision Materials, Inc., with a content of germanium fine particles of 8.6 wt %) was used as a dispersion of germanium fine particles. In this Example, this germanium fine particles may be referred to as "Ge (Lot#1)".

The form and the particle size distribution of the germanium fine particles (Ge (Lot#1)) in the produced heat-insulating layer were determined by image analysis of an SEM image in the same manner as in Example 1. As a result, the germanium fine particles were in the form of flakes, and in the particle size distribution, D10 was 42 nm, D90 was 200 nm, and the median was 95 nm. The particle size distribution of the germanium fine particles in the dispersion was determined using an ultrasonic particle size distribution analyzer. As a result, D10 was 4 nm, D90 was 125 nm, and the median was 40 nm.

In addition to this, the image analysis demonstrated that the heat-insulating layer composed of germanium fine particles had a peculiar structure (see FIG. 12B) in the same manner as the heat-insulating layer composed of silicon fine particles in Example 1. This structure showed the following specific features: comparatively large fine particles were mostly distributed in the lower portion (portion on the side of the base layer) of the heat-insulating layer, and comparatively small fine particles were mostly distributed in the upper portion (the portion opposite to the base layer) thereof the fine particles in the lower portion were mainly the secondary particles formed by agglomeration of the primary particles, and the particles in the upper portion were mainly the primary particles and the secondary particles that were comparatively small; and adjacent fine particles were bound to each other at a binding portion with a very small area. The binding portion between the fine particles was independently observed using TEM. As a result, it was found that an oxide film ($GeO_x(1 \leqq x \leqq 2)$ film) with a thickness of about 2 to 10 nm was present on an interface that serves as the binding portion between the fine particles, and the fine particles were bound to each other through the oxide film, in the same manner as in the heat-insulating layer composed of silicon fine particles in Example 1.

Independently of this, RBS analysis was performed for the produced heat-insulating layer with being etched from its upper portion, so that the void fraction of the heat-insulating layer was determined. The void fraction of the heat-insulating layer was about 50% in the top portion and about 90% in the bottom portion, showing a tendency of gradual increase from the top portion toward the bottom portion.

Independently of this, the WAXD profile and the Raman spectroscopy profile were determined for the produced heat-insulating layer. As a result, diffraction peaks were observed at diffraction angles 2θ of 27.3°, 45.3°, 53.7°, 66.0°, 72.8° and 83.7° in the WAXD profile of the heat-insulating layer composed of germanium fine particles, and a peak was observed at a Raman shift of 297 $cm^{-1}$ in the Raman spectroscopy profile thereof. These diffraction peaks and the Raman shift were peaks and a shift specific to germanium crystal. That is, it was confirmed that the produced heat-insulating layer was composed of crystalline germanium fine particles.

Table 4 below shows the configuration of the produced sound wave generator. The parenthesis number in each box of Table 4 denotes the thickness of each layer.

TABLE 4

| | BASE LAYER | HEAT-INSULTING LAYER | HEAT-GENERATING LAYER |
|---|---|---|---|
| Ex. 2-1 | GRAPHITE (200 μm) | Ge (Lot#1) (240 nm) | CARBON MATERIAL (50 nm) |
| Ex. 2-2 | SAPPHIRE (500 μm) | Ge (Lot#1) (240 nm) | CARBON MATERIAL (50 nm) |
| Ex. 2-3 | SAPPHIRE (500 μm) | | Ge (Lot#1) (240 nm) |
| C. Ex. 2-A | DIAMOND (500 μm) | Ge (Lot#1) (240 nm) | CARBON MATERIAL (50 nm) |

In Example 2-3, the heat-generating layer composed of carbon material was not formed, and the heat-insulating layer composed of germanium fine particles was allowed to function also as the heat-generating layer, as shown in Table 4. This is based on the fact that the germanium fine particles exhibit an electrical conductivity by heat treatment at 400 to 600° C., and thus the heat-insulating layer shows a sheet resistance suitable as the heat-generating layer. It is inferred that the electrical conductivity was exhibited because $GeO_2$ between the germanium fine particles were likely to turn into $GeO_x$ ($1 \leqq x \leqq 2$) due to their deliquescence properties and thus conduction paths were formed between the fine particles.

Next, the output properties of the produced sound wave generator were measured using the measurement system shown in FIG. 14 in the same manner as in Example 1. The distance between the sound wave generator and the sound collecting microphone was set to 5 mm.

In any of Examples 2-1 to 2-3, the same results as in Example 1-1 were obtained, though the maximum values of the output sound pressure were different. For example, upon application of electrical pulses having a rectangular waveform, emission of sound waves in the form of impulses with a frequency corresponding to the modulation of the electrical pulses was observed as in Example 1-1. Further, the maximum sound pressure of the sound waves to be emitted was proportional to the applied electric power in Examples 2-1 to 2-3, for example. These demonstrate that the sound wave generation mechanism in Examples 2-1 to 2-3 is based on the sound wave generation of thermal induction type.

Table 5 below shows the sound pressure (output sound pressure per unit of applied electric power) of the sound waves emitted by each of Examples and Comparative Examples shown in Table 4.

TABLE 5

| | BASE LAYER | HEAT-INSULTING LAYER | OUTPUT SOUND PRESSURE PER UNIT OF APPLIED ELECTRIC POWER ($\times 10^{-3}$ Pa/W) |
|---|---|---|---|
| Ex. 2-1 | GRAPHITE (200 μm) | Ge (Lot#1) (240 nm) | 213 |
| Ex. 2-2 | SAPPHIRE (500 μm) | Ge (Lot#1) (240 nm) | 204 |
| Ex. 2-3 | SAPPHIRE (500 μm) | Ge (Lot#1) (240 nm) | 134 |
| C. Ex. 2-A | DIAMOND (500 μm) | Ge (Lot#1) (240 nm) | 22 |

As shown in Table 5, when sapphire that had a thermophysical parameter αC considerably lower than that of diamond (Comparative Example 2-A) was used for the base layer (Examples 2-2 and 2-3), high output properties were achieved. In Examples 2-2 and 2-3, Example 2-2 exhibited higher output properties. Also when graphite was used for the base layer (Example 2-1), high output properties were achieved as well. It was not until the combination of the base layer composed of sapphire or graphite and the heat-insulating layer composed of crystalline germanium fine particles was found to be optimal in this Example that such high output properties were achieved. Those skilled in the art never could expect or achieve the results of this Example based on conventional sound wave generators and the technical ideas thereof that disclose a technique for increasing the thermal contrast between the base layer and the heat-insulating layer as much as possible.

In addition to this, it was confirmed that the heat-insulating layer composed of germanium fine particles that had been subjected to heat treatment in a particular temperature range functioned also as a heat pulse source (heat pulse-generating layer) by application of electrical pulses.

The output properties of the sound waves to be emitted were measured with varying the thickness of the heat-insulating layer in Examples 2-1 to 2-3. It was confirmed that the thickness of the heat-insulating layer was preferably at least 10 nm and less than 50 μm, more preferably at least 50 nm but not more than 10 μm.

Example 3

A sound wave generator having a heat-insulating layer composed of crystalline silicon fine particles with a different form from those in Example 1 was produced in Example 3. Then, the combination of the heat-insulating layer and a base layer was examined by changing the material constituting the base layer.

The sound wave generator used for the examination was produced in the same manner as in each of Examples and Comparative Examples in Example 1 except that the dispersion of silicon fine particles was different.

An IPA dispersion of crystalline silicon fine particles that were in the form of spheres (manufactured by EMPA, with a content of silicon fine particles of 5 wt %) was used as a dispersion of silicon fine particles. In this example, this silicon fine particles may be referred to as "Si (Lot#2)".

Figure 17:
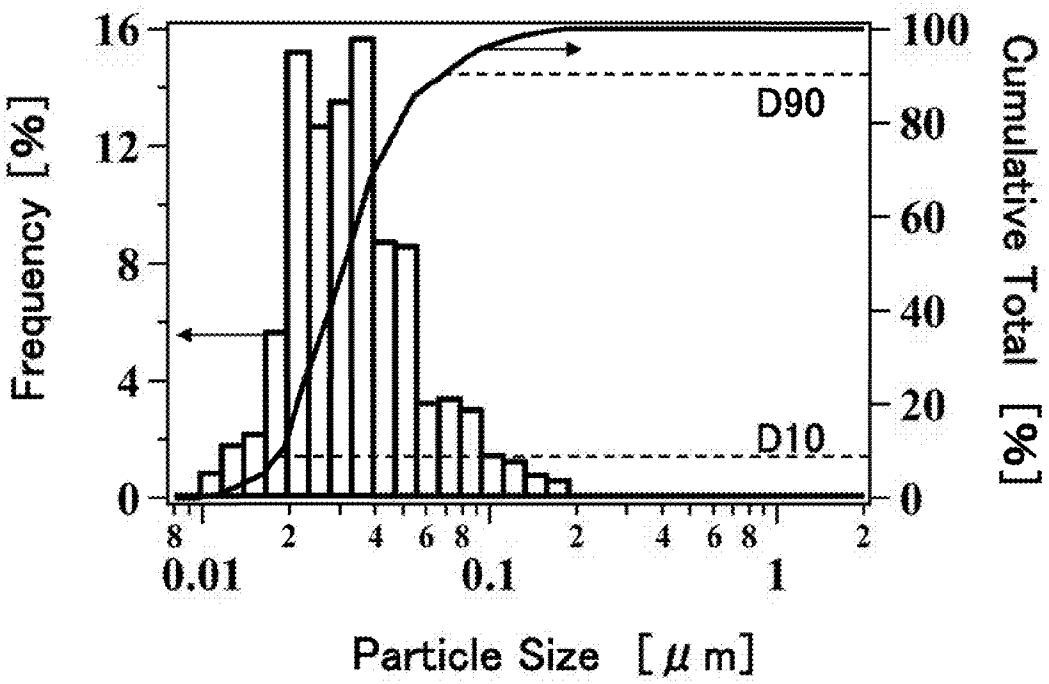
FIG. 17 is a graph showing the determination results of the particle size distribution for the silicon fine particles used in Example 3.

The form and the particle size distribution of the silicon fine particles (Si (Lot#2)) in the produced heat-insulating layer were determined by image analysis of an SEM image in the same manner as in Example 1. The silicon fine particles were in the form of spheres, and in the particle size distribution, D10 was 19 nm, D90 was 68 nm, and the median was 32 nm. FIG. 17 shows the determination results of the particle size distribution for the silicon fine particles (Si (Lot#2)). The particle size distribution of the silicon fine particles in the dispersion was determined using an ultrasonic particle size distribution analyzer. As a result, D10 was 10 nm, D90 was 100 nm, and the median was 20 nm.

In addition to this, the image analysis demonstrated that the heat-insulating layer composed of silicon fine particles had a peculiar structure shown in FIG. 18A to FIG. 18D. This structure showed the following specific features: comparatively large fine particles were mostly distributed in the lower portion (portion on the side of the base layer 11) of the heat-insulating layer 12, and comparatively small fine particles were mostly distributed in the upper portion (portion opposite to the base layer 11) thereof; the fine particles in the lower portion were mainly the secondary particles 54 formed by agglomeration of the primary particles 53, and the particles in the upper portion were mainly the primary particles 53 and the secondary particles 54 that were comparatively small; and adjacent fine particles were bound to each other at a binding portion with a very small area. The binding portion between the fine particles was independently observed using TEM. As a result, it was found that an oxide film ($SiO_2$ film) with a thickness of about 2 to 10 nm was present on an interface that serves as the binding portion between the fine particles, and the fine particles were bound to each other through the oxide film, in the same manner as in the heat-insulating layer composed of silicon fine particles in Example 1.

Independently of this, RBS analysis was performed for the produced heat-insulating layer with being etched from the upper portion, so that the void fraction of the heat-insulating layer was determined. The void fraction of the heat-insulating layer was about 50% in the top portion and about 90% in the bottom portion, showing a tendency of gradual increase from the top portion toward the bottom portion.

Independently of this, the WAXD profile and the Raman spectroscopy profile were determined for the produced heat-insulating layer. As a result, diffraction peaks were observed at diffraction angles 2θ of 28.5°, 47.3° and 56.1° in the WAXD profile of the heat-insulating layer composed of silicon fine particles, and a peak was observed at a Raman shift of 522 $cm^{-1}$ in the Raman spectroscopy profile thereof. These diffraction peaks and the Raman shift were peaks and a shift specific to silicon crystal. That is, it was confirmed that the produced heat-insulating layer was composed of crystalline silicon fine particles.

Table 6 below shows the configuration of the produced sound wave generator. The parenthesis number in each box of Table 6 denotes the thickness of each layer.

TABLE 6

| | BASE LAYER | HEAT-INSULTING LAYER | HEAT-GENERATING LAYER |
|---|---|---|---|
| Ex. 3-1 | GRAPHITE (200 μm) | Si (Lot#2) (300 nm) | CARBON MATERIAL (50 nm) |
| Ex. 3-2 | SAPPHIRE (500 μm) | Si (Lot#2) (300 nm) | CARBON MATERIAL (50 nm) |
| C. Ex. 3-A | DIAMOND (500 μm) | Si (Lot#2) (300 nm) | CARBON MATERIAL (50 nm) |
| C. Ex. 3-B | SILICON (500 μm) | Si (Lot#2) (300 nm) | CARBON MATERIAL (50 nm) |

Next, the output properties of the produced sound wave generator were measured using the measurement system shown in FIG. 14 in the same manner as in Example 1. The distance between the sound wave generator and the sound collecting microphone was set to 5 mm.

In both of Examples 3-1 and 3-2, the same results as in Example 1-1 were obtained, though the maximum values of the output sound pressure were different. For example, upon application of electrical pulses having a rectangular waveform, emission of sound waves in the form of impulses with a frequency corresponding to the modulation of the electrical pulses was observed in the same manner as in Example 1-1. Further, the maximum sound pressure of the sound waves to be emitted was proportional to the applied electric power, in Examples 3-1 and 3-2, for example. These demonstrate that the sound wave generation mechanism in Examples 3-1 and 3-2 is based on the sound wave generation of thermal induction type.

Table 7 below shows the sound pressure (output sound pressure per unit of applied electric power) of the sound waves emitted by each of Examples and Comparative Examples shown in Table 6.

TABLE 7

| | BASE LAYER | HEAT-INSULTING LAYER | OUTPUT SOUND PRESSURE PER UNIT OF APPLIED ELECTRIC POWER ($\times 10^{-3}$ Pa/W) |
|---|---|---|---|
| Ex. 3-1 | GRAPHITE (200 μm) | Si (Lot#2) (300 nm) | 228 |
| Ex. 3-2 | SAPPHIRE (500 μm) | Si (Lot#2) (300 nm) | 576 |
| C. Ex. 3-A | DIAMOND (500 μm) | Si (Lot#2) (300 nm) | 30 |
| C. Ex. 3-B | SILICON (500 μm) | Si (Lot#2) (300 nm) | 10 |

As shown in Table 7, when sapphire that had a thermophysical parameter αC considerably lower than those of diamond (Comparative Example 3-A) and silicon (Comparative Example 3-B) was used for the base layer (Example 3-2), high output properties were achieved. High output properties were achieved also when graphite was used for the base layer (Example 3-1). The output properties were far higher in Example 3-2 that used sapphire for the base layer than in Example 3-1 that used graphite for the base layer. It was not until the combination of the base layer composed of sapphire or graphite and the heat-insulating layer composed of silicon fine particles was found to be optimal in this Example that such high output properties were achieved. Those skilled in the art never could expect or achieve the results of this Example based on conventional sound wave generators and the technical ideas thereof that disclose a technique for increasing the thermal contrast between the base layer and the heat-insulating layer as much as possible.

Example 4

In Example 4, a sound wave generator in which the combination of a base layer and a heat-insulating layer was the same as that of Example 1-1 and the surface from which sound waves were emitted was in the form of a paraboloid was produced. The output properties were examined for the sound wave generator.

The sound wave generator used for the examination was produced in the same manner as in Example 1-1 except that the form of the surface of the graphite base layer on which the heat-insulating layer was disposed was changed from plane to parabolic. The graphite base layer was formed by stacking and laminating two or more flexible graphite sheets (with a thickness of 50 μm to 1 mm, typically 100 μm) onto a parabolic surface that had been formed in a mold and thereafter separating the stack of the graphite sheets from the mold. The diameter of the graphite base layer was set to 20 mm.

Figure 19:
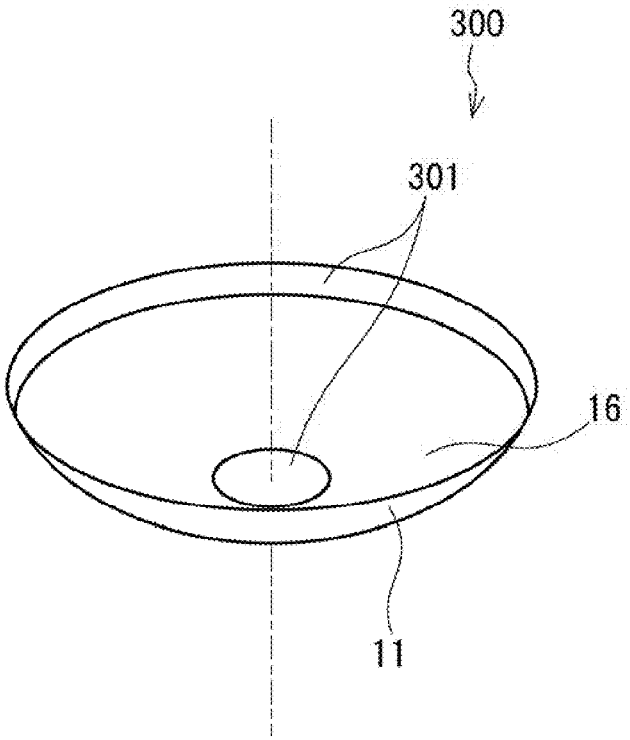
FIG. 19 is a perspective view schematically showing the sound wave generator of the present invention produced in Example 4.

One of Pt electrodes for applying electrical pulses to the heat-generating layer was arranged in the form of a ring (with a width of 1 mm) at the periphery of the heat-generating layer, and the other was arranged in the form of a circle with a diameter of 3 mm at the center of the heat-generating layer. FIG. 19 shows a sound wave generator 300 thus produced. In FIG. 19, the reference numeral 11 denotes the base layer, the reference numeral 16 denotes the heat-generating layer, and the reference numeral 301 denotes the electrodes. The heat-insulating layer is interposed between the base layer 11 and the heat-generating layer 16.

Next, the output properties of the produced sound wave generator were measured using the measurement system shown in FIG. 14 in the same manner as in Example 1. The sound collecting microphone was moved along the central axis of an emitting surface of sound waves in the sound wave generator so as to be gradually spaced away from the emitting surface. When the distance from the emitting surface to the sound collecting microphone was 7 mm, the highest output sound pressure was obtained. This demonstrates that the sound wave generator of sound collecting type could be achieved by making the emitting surface parabolic.

In addition to this, upon application of electrical pulses having a rectangular waveform, emission of sound waves in the form of impulses with a frequency corresponding to the modulation of the electrical pulses was observed in the same manner as in Example 1-1. Example 4 demonstrated that sound wave generators each having a sound wave emitting surface in various forms were well feasible.

INDUSTRIAL APPLICABILITY

The sound wave generator of the present invention has high degree of freedom in the form and can be formed by drying and heat treatment of a coating layer. Therefore, the sound wave generator of the present invention can be applied to various electronic devices. The sound wave generator of the present invention can be applied to various uses, such as a sound source (ultrasound source) that is mounted directly on a three-dimensional object, a speaker, an actuator, and the like, for example.

The present invention may be embodied in other forms without departing from the spirit or essential characteristics thereof. The embodiments described in this specification are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sound wave generator comprising:

a base layer;

a heat-insulating layer disposed on the base layer; and a heat pulse source that applies heat pulses to the heat-insulating layer, wherein the base layer is composed of graphite or sapphire, and the heat-insulating layer is composed of crystalline fine particles containing germanium.

2. The sound wave generator according to claim 1, wherein the base layer is composed of sapphire.

3. The sound wave generator according to claim 2, wherein the heat pulse source comprises:

a heat pulse-generating layer disposed on a surface of the heat-insulating layer opposite to the base layer and applies heat pulses to the heat-insulating layer.

4. The sound wave generator according to claim 3, wherein the heat pulse-generating layer is an electric heating layer that generates heat pulses using a pulse current or a pulse voltage to be supplied to the heat pulse-generating layer, and the heat pulse source further comprises electric power supply lines that supply the pulse current or the pulse voltage to the electric heating layer.

5. The sound wave generator according to claim 3, wherein the heat pulse-generating layer is composed of carbon material.

6. The sound wave generator according to claim 2, wherein the fine particles in the heat-insulating layer have a particle size distribution with a median of at least 10 nm but not more than 0.5 μm.

7. A method for producing the sound wave generator of claim 2, comprising:

a first step of forming, on a base layer composed of sapphire, a coating layer of a solution in which crystalline fine particles containing germanium are dispersed, followed by heat treatment of the formed coating layer, so as to form a heat-insulating layer composed of the fine particles on the base layer; and a second step of providing a heat pulse source that applies heat pulses to the heat-insulating layer.

8. The method for producing the sound wave generator according to claim 7, wherein the heat pulse source comprises a heat pulse-generating layer disposed on a surface of the heat-insulating layer opposite to the base layer and applies heat pulses to the heat-insulating layer, the heat pulse-generating layer is composed of carbon material, the second step comprises forming a coating layer of a precursor solution that turns into the carbon material by heat treatment on the surface of the heat-insulating layer opposite to the base layer that has been formed in the first step, followed by heat treatment of the formed coating layer, so as to form the heat pulse-generating layer.

9. The sound wave generator according to claim 1, wherein the base layer is composed of graphite.

10. The sound wave generator according to claim 9, wherein the heat pulse source comprises:

a heat pulse-generating layer disposed on a surface of the heat-insulating layer opposite to the base layer and applies heat pulses to the heat-insulating layer.

11. The sound wave generator according to claim 10, wherein the heat pulse-generating layer is an electric heating layer that generates heat pulses using a pulse current or a pulse voltage to be supplied to the heat pulse-generating layer, and the heat pulse source further comprises electric power supply lines that supply the pulse current or the pulse voltage to the electric heating layer.

12. The sound wave generator according to claim 10, wherein the heat pulse-generating layer is composed of carbon material.

13. The sound wave generator according to claim 9, wherein the fine particles in the heat-insulating layer have a particle size distribution with a median of at least 10 nm but not more than 0.5 μm.

14. A method for producing the sound wave generator of claim 9, comprising:

a first step of forming, on a base layer composed of graphite, a coating layer of a solution in which crystalline fine particles containing germanium are dispersed, followed by heat treatment of the formed coating layer, so as to form a heat-insulating layer composed of the fine particles on the base layer; and a second step of providing a heat pulse source that applies heat pulses to the heat-insulating layer.

15. The method for producing the sound wave generator according to claim 14, wherein the heat pulse source comprises a heat pulse-generating layer disposed on a surface of the heat-insulating layer opposite to the base layer and applies heat pulses to the heat-insulating layer, the heat pulse-generating layer is composed of carbon material, the second step comprises forming a coating layer of a precursor solution that turns into the carbon material by heat treatment on the surface of the heat-insulating layer opposite to the base layer that has been formed in the first step, followed by heat treatment of the formed coating layer, so as to form the heat pulse-generating layer.

16. A method for generating sound waves using a sound wave generator, wherein the sound wave generator comprises a base layer, a heat-insulating layer disposed on the base layer, and a heat pulse source that applies heat pulses to the heat-insulating layer, the base layer is composed of graphite or sapphire, the heat-insulating layer is composed of crystalline fine particles containing germanium, and the method comprises a step of applying heat pulses to the heat-insulating layer by the heat pulse source so as to generate sound waves.

17. The method for generating sound waves using a sound wave generator according to claim 16, wherein the base layer is composed of sapphire.

18. The method for generating sound waves according to claim 17, wherein the heat pulse source comprises a heat pulse-generating layer disposed on a surface of the heat-insulating layer opposite to the base layer and applies heat pulses to the heat-insulating layer.

19. The method for generating sound waves according to claim 18, wherein the heat pulse-generating layer is an electric heating layer that generates heat pulses using a pulse current or a pulse voltage to be supplied to the heat pulse-generating layer, the heat pulse source further comprises electric power supply lines that supply the pulse current or the pulse voltage to the electric heating layer, and the step is generating heat pulses in the electric heating layer using the pulse current or the pulse voltage supplied to the electric heating layer via the electric power supply lines, followed by application of the generated heat pulses to the heat-insulating layer, so as to generate sound waves.

20. The method for generating sound waves using a sound wave generator according to claim 16, wherein the base layer is composed of graphite.

21. The method for generating sound waves according to claim 20, wherein the heat pulse source comprises a heat pulse-generating layer disposed on a surface of the heat-insulating layer opposite to the base layer and applies heat pulses to the heat-insulating layer.

22. The method for generating sound waves according to claim 21, wherein the heat pulse-generating layer is an electric heating layer that generates heat pulses using a pulse current or a pulse voltage to be supplied to the heat pulse-generating layer, the heat pulse source further comprises electric power supply lines that supply the pulse current or the pulse voltage to the electric heating layer, and the step is generating heat pulses in the electric heating layer using the pulse current or the pulse voltage supplied to the electric heating layer via the electric power supply lines, followed by application of the generated heat pulses to the heat-insulating layer, so as to generate sound waves.

23. A sound wave generator comprising:

a base layer;

a heat-insulating layer disposed on the base layer; and a heat pulse source that applies heat pulses to the heat-insulating layer, wherein the base layer is composed of graphite or sapphire, and the heat-insulating layer is composed of crystalline fine particles containing silicon.

24. The sound wave generator according to claim 23, wherein the heat pulse source comprises:

a heat pulse-generating layer disposed on a surface of the heat-insulating layer opposite to the base layer and applies heat pulses to the heat-insulating layer.

25. The sound wave generator according to claim 24, wherein the heat pulse-generating layer is an electric heating layer that generates heat pulses using a pulse current or a pulse voltage to be supplied to the heat pulse-generating layer, and the heat pulse source further comprises electric power supply lines that supply the pulse current or the pulse voltage to the electric heating layer.

26. The sound wave generator according to claim 24, wherein the heat pulse-generating layer is composed of carbon material.

27. The sound wave generator according to claim 23, wherein the fine particles in the heat-insulating layer have a particle size distribution with a median of at least 10 nm but not more than 0.5 μm.

28. A method for producing the sound wave generator of claim 23, comprising:

a first step of forming, on a base layer composed of graphite or sapphire, a coating layer of a solution in which crystalline fine particles containing silicon are dispersed, followed by heat treatment of the formed coating layer, so as to form a heat-insulating layer composed of the fine particles on the base layer; and a second step of providing a heat pulse source that applies heat pulses to the heat-insulating layer.

29. The method for producing the sound wave generator according to claim 28, wherein the heat pulse source comprises a heat pulse-generating layer disposed on a surface of the heat-insulating layer opposite to the base layer and applies heat pulses to the heat-insulating layer, the heat pulse-generating layer is composed of carbon material, the second step comprises forming a coating layer of a precursor solution that turns into the carbon material by heat treatment on the surface of the heat-insulating layer opposite to the base layer that has been formed in the first step, followed by heat treatment of the formed coating layer, so as to form the heat pulse-generating layer.

30. A method for generating sound waves using a sound wave generator, wherein the sound wave generator comprises a base layer, a heat-insulating layer disposed on the base layer, and a heat pulse source that applies heat pulses to the heat-insulating layer, the base layer is composed of graphite or sapphire, the heat-insulating layer is composed of crystalline fine particles containing silicon, and the method comprises a step of applying heat pulses to the heat-insulating layer by the heat pulse source so as to generate sound waves.

31. The method for generating sound waves according to claim 30, wherein the heat pulse source comprises a heat pulse-generating layer disposed on a surface of the heat-insulating layer opposite to the base layer and applies heat pulses to the heat-insulating layer.

32. The method for generating sound waves according to claim 31, wherein the heat pulse-generating layer is an electric heating layer that generates heat pulses using a pulse current or a pulse voltage to be supplied to the heat pulse-generating layer, the heat pulse source further comprises electric power supply lines that supply the pulse current or the pulse voltage to the electric heating layer, and the step is generating heat pulses in the electric heating layer using the pulse current or the pulse voltage supplied to the electric heating layer via the electric power supply lines, followed by application of the generated heat pulses to the heat-insulating layer, so as to generate sound waves.

* * * * *